US008188956B2

(12) United States Patent
Oke et al.

(10) Patent No.: US 8,188,956 B2
(45) Date of Patent: May 29, 2012

(54) DISPLAY DEVICE WITH TONE CORRECTION CIRCUIT

(75) Inventors: Ryutaro Oke, Chiba (JP); Masafumi Hirata, Oamishirasato (JP); Shisei Katou, Mobara (JP); Chiharu Kawaguchi, Mobara (JP)

(73) Assignees: Hitachi Displays, Ltd., Chiba (JP); Panasonic Liquid Crystal Display Co., Ltd., Hyogo (JP)

( * ) Notice: Subject to any disclaimer, the term of this patent is extended or adjusted under 35 U.S.C. 154(b) by 1157 days.

(21) Appl. No.: 12/021,314

(22) Filed: Jan. 29, 2008

(65) Prior Publication Data

US 2009/0102766 A1 Apr. 23, 2009

(30) Foreign Application Priority Data

Jan. 29, 2007 (JP) ..... 2007-017375
Jul. 30, 2007 (JP) ..... 2007-197650

(51) Int. Cl.
*G09G 3/36* (2006.01)

(52) U.S. Cl. ..... 345/88; 345/87

(58) Field of Classification Search ..... 345/87–104
See application file for complete search history.

(56) References Cited

U.S. PATENT DOCUMENTS

2002/0024481 A1* 2/2002 Kawabe et al. ..... 345/87
2002/0033789 A1* 3/2002 Miyata et al. ..... 345/89
2003/0034947 A1* 2/2003 Tanaka et al. ..... 345/89
2005/0041047 A1* 2/2005 Miyata et al. ..... 345/690
2005/0062701 A1* 3/2005 Furuhashi et al. ..... 345/89
2005/0179854 A1* 8/2005 Sekine et al. ..... 349/161
2006/0097980 A1* 5/2006 Hasegawa ..... 345/102
2006/0176260 A1* 8/2006 Koyama ..... 345/89
2007/0085790 A1* 4/2007 Chung et al. ..... 345/88
2007/0091041 A1* 4/2007 Chung et al. ..... 345/88
2007/0115246 A1* 5/2007 Hayashi et al. ..... 345/102

FOREIGN PATENT DOCUMENTS

JP 10-090712 4/1998
JP 10-90712 4/1998

* cited by examiner

*Primary Examiner* — Alexander Eisen
*Assistant Examiner* — Nelson Lam
(74) *Attorney, Agent, or Firm* — Antonelli, Terry, Stout & Kraus, LLP.

(57) ABSTRACT

The present invention prevents a TFT liquid crystal display device from deteriorating its image quality due to the insufficiency of voltage written through TFTs. There is disclosed a display device that includes a display panel in which the plural pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plural pixel electrodes against the tone of video data to be written into a preceding pixel electrode that is connected through a TFT to the video signal line, to which the one of the plural pixel electrodes is also connected through a TFT, and placed one position toward a signal input end of the video signal line as compared to the one of the plural pixel electrodes, and corrects the video data to be written into the one of the plural pixel electrodes.

14 Claims, 17 Drawing Sheets

DISPLAY DEVICE WITH TONE CORRECTION CIRCUIT

CLAIM OF PRIORITY

The present application claims priority from Japanese Application JP2007-017375 filed on Jan. 29, 2007 and Japanese Application JP 2007-197650 filed on Jul. 30, 2007, the content of which is hereby incorporated by reference into this application.

BACKGROUND OF THE INVENTION

1. Field of the Invention

The present invention relates to a display device, and more particularly to a technology that can be effectively applied to a TFT liquid crystal display device.

2. Description of the Related Art

A TFT liquid crystal display device has been used as a display device for TVs, personal computer monitors, and the like.

The TFT liquid crystal display device has a liquid crystal display panel that is obtained by interposing liquid crystal between two substrates. One of the two substrates is generally referred to as a TFT substrate. The TFT substrate is obtained, for instance, by forming plural scanning signal lines, plural video signal lines, plural TFTs, and plural pixel electrodes on the surface of a glass substrate or other insulated substrate. The other substrate is generally referred to as a counter substrate. The counter substrate is obtained, for instance, by forming a lighttight film for dividing a display area into individual pixel regions and a color filter on the surface of a glass substrate or other insulated substrate. Counter electrodes, which drive the liquid crystal in conjunction with the pixel electrodes, are formed on either the TFT substrate or the counter substrate.

The liquid crystal display panel has a display area for displaying motion pictures and still pictures. The display area is composed of a large number of pixels. Each pixel has a TFT and a pixel electrode that is connected to the source of the TFT. In this instance, the drain of each TFT is connected to a video signal line, whereas the gate of each TFT is connected to a scanning signal line. As regards the source and drain of each TFT, this document assumes that the source is connected to a pixel electrode while the drain is connected to a video signal line. In some cases, however, the reverse may apply. More specifically, it may be assumed that the drain is connected to a pixel electrode while the source is connected to a video signal line.

In the above-mentioned conventional liquid crystal display panel, plural pixel electrodes that are positioned between two neighboring video signal lines and arranged in the extending direction of the video signal lines are connected, for instance, to one of the two neighboring video signal lines through a TFT connected to each pixel electrode. In this case, a common conventional liquid crystal display panel is configured so that all the drains of TFTs connected to the pixel electrodes are connected to the same video signal line of the two neighboring video signal lines.

In a recently developed liquid crystal display panel, which is disclosed, for instance, by Japanese Patent JP-A No. 1998-90712, a TFT whose drain is connected to one of two neighboring video signal lines and a TFT whose drain is connected to the other video signal line are positioned between the two neighboring video signal lines and alternately arranged in the extending direction of the video signal lines. In the above liquid crystal display panel, plural pixel electrodes, which are positioned between two neighboring video signal lines and arranged in the extending direction of the video signal lines, are configured so that, for example, a pixel electrode connected to one of the two neighboring video signal lines through a TFT and a pixel electrode connected to the other video signal line are alternately arranged in the extending direction of the video signal lines.

In recent years, liquid crystal TVs and other liquid crystal display devices have increased their refresh rates in order to minimize screen flicker and improve motion picture display performance.

However, when the refresh rates of conventional liquid crystal display devices were increased, tone voltages written into the pixel electrodes through the TFTs were insufficient. This resulted in image quality deterioration.

Further, when the conventional liquid crystal display devices were used, plural pixel electrodes whose drains were connected to the same video signal line differed in written tone voltage insufficiency. Thus, a phenomenon called "lateral stripes" occurred to the detriment of image quality.

SUMMARY OF THE INVENTION

An object of the present invention is to provide a technology for preventing a liquid crystal display device from deteriorating its image quality.

The foregoing and other objects and new features of the present invention will become more fully apparent from the following description and appended drawings.

Representative aspects of the present invention will now be outlined below:

(1) According to one aspect of the present invention, there is provided a display device including: plural scanning signal lines; plural video signal lines; plural TFTs; plural pixel electrodes connected to sources of the TFTs; a display panel in which the plural pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plural pixel electrodes against the tone of video data to be written into a preceding pixel electrode that is connected through a TFT to the video signal line, to which the one of the plural pixel electrodes is also connected through a TFT, and placed one position toward a signal input end of the video signal line as compared to the one of the plural pixel electrodes, and corrects the video data to be written into the one of the plural pixel electrodes.

(2) According to another aspect of the present invention, there is provided the display device as described in (1) above, wherein the correction circuit includes a line memory that is positioned between two neighboring scanning signal lines, which are included in one frame period of video data, to store video data to be written into each of plural pixel electrodes arranged in the extending direction of the scanning signal lines.

(3) According to another aspect of the present invention, there is provided the display device as described in (1) or (2) above, wherein the correction circuit includes a tone correction section which, when the difference between the tone of video data to be written into the one of the plural pixel electrodes and the tone of video data to be written into the preceding pixel electrode is greater than a specific value, makes a correction by changing the tone of video data to be written into the one of the plural pixel electrodes.

(4) According to another aspect of the present invention, there is provided the display device as described in (3) above, wherein the tone correction section varies the amount of tone correction for the video data to be written into the one of the plural pixel electrodes in accordance with the difference between the tone of video data to be written into the one of the plural pixel electrodes and the tone of video data to be written into the preceding pixel electrode.

(5) According to another aspect of the present invention, there is provided the display device as described in (3) or (4) above, wherein, when the distance between the one of the plural pixel electrodes and the signal input end of the video signal line is greater than a predetermined value, the tone correction section corrects the tone of the video data.

(6) According to another aspect of the present invention, there is provided the display device as described in (3) or (4) above, wherein the tone correction section varies the amount of tone correction for the video data in accordance with the distance between the one of the plural pixel electrodes and the signal input end of the video signal line.

(7) According to another aspect of the present invention, there is provided the display device as described in (1) or (2) above, wherein the correction circuit includes a tone correction section which makes a correction by applying to the beginning of video data to be written into the one of the plural pixel electrodes a signal having a voltage different from a voltage corresponding to the tone of the video data in accordance with the difference between the tone of video data to be written into the one of the plural pixel electrodes and the tone of video data to be written into the preceding pixel electrode.

(8) According to another aspect of the present invention, there is provided the display device as described in (7) above, wherein, when the distance between the one of the plural pixel electrodes and the signal input end of the video signal line is greater than a predetermined value, the tone correction section makes a correction by applying a signal having a voltage different from a voltage corresponding to the tone of video data to be written into the one of the plural pixel electrodes.

(9) According to another aspect of the present invention, there is provided the display device as described in (7) above, wherein the tone correction section varies one or both of the magnitude and application time of a voltage different from a voltage corresponding to the tone of video data to be written into the one of the plural pixel electrodes in accordance with the distance between the one of the plural pixel electrodes and the signal input end of the video signal line.

(10) According to another aspect of the present invention, there is provided the display device as described in any one of (1) to (9) above, wherein the display panel is a liquid crystal display panel that is obtained by interposing liquid crystal between two substrates.

(11) According to another aspect of the present invention, there is provided a display device including: plural scanning signal lines; plural video signal lines; plural TFTs; plural pixel electrodes connected to sources of the TFTs; and a display panel in which the plural pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; wherein gates for plural TFTs arranged in the extending direction of the scanning signal lines are respectively connected to the plural scanning signal lines; wherein scanning signals for turning ON the TFTs at predetermined time intervals for a period shorter than the predetermined time intervals are respectively applied to the plural scanning signal lines; and wherein the time during which the scanning signals applied respectively to the plural scanning signal lines turn ON the TFTs is shorter than the time that is obtained by dividing the time intervals by the total number of the scanning signal lines.

(12) According to another aspect of the present invention, there is provided the display device as described in (11) above, wherein the scanning signals are such that the time difference between the time at which the state of a certain TFT changes from OFF to ON and the time at which a video signal applied to the video signal line changes to the signal to be written into a pixel electrode connected to the source of the TFT is shorter than the time difference between the time at which the state of the TFT changes from ON to OFF and the time at which a video signal applied to the video signal line changes to the signal to be written into a pixel electrode subsequent to a pixel electrode connected to the source of the TFT.

(13) According to still another aspect of the present invention, there is provided the display device as described in (11) or (12) above, wherein the display panel is a liquid crystal display panel that is obtained by interposing liquid crystal between two substrates.

The display device according to the present invention can avoid image quality deterioration that may occur due to the difference in the insufficiency of tone voltage written into pixel electrodes through the TFTs.

DETAILED DESCRIPTION OF THE PREFERRED EMBODIMENTS

Figure 1A:
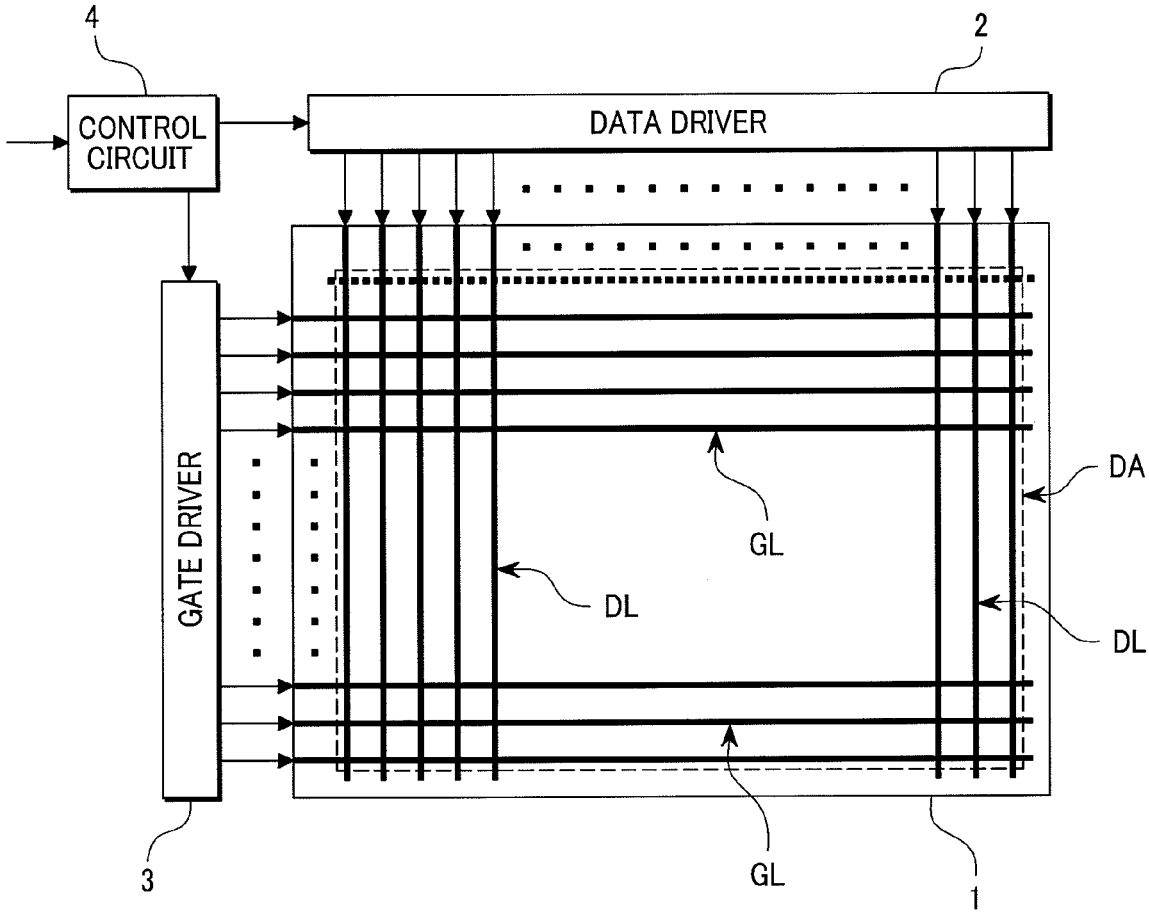
FIG. 1A is a schematic block diagram illustrating a typical configuration of a liquid crystal display device according to the present invention.

Embodiments of the present invention will now be described in detail with reference to the accompanying drawings.

In all the drawings used to describe the embodiments, elements having the same functions are identified by the same reference numerals and will not be repeatedly described.

Figure 1B:
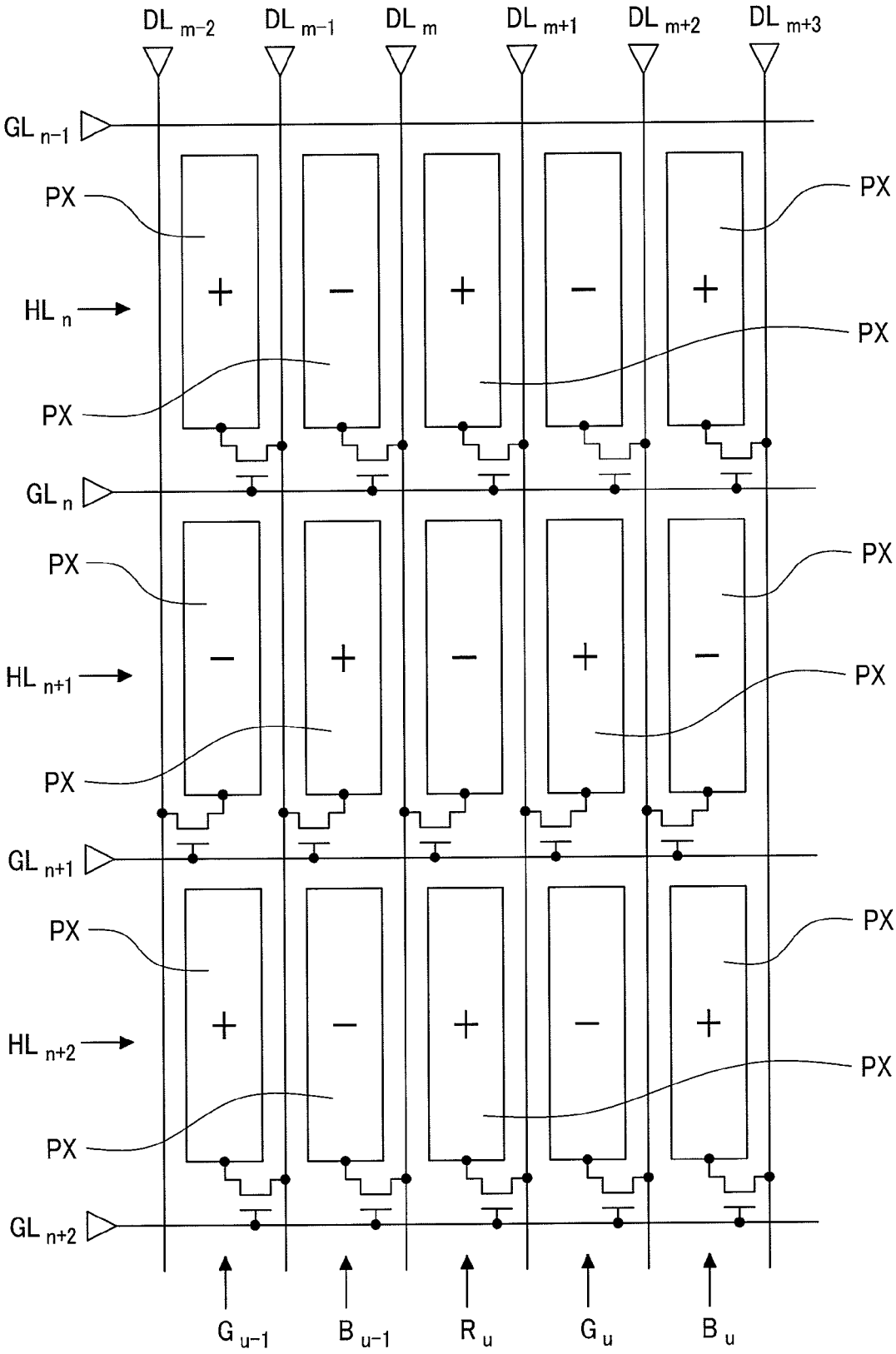
FIG. 1B is a schematic circuit diagram illustrating a typical display area configuration of a liquid crystal display panel that is shown in FIG. 1A.

FIGS. 1A and 1B are schematic diagrams illustrating an example of a display device according to the present invention.

FIG. 1A is a schematic block diagram illustrating a typical configuration of a liquid crystal display device according to the present invention. FIG. 1B is a schematic circuit diagram illustrating a typical display area configuration of a liquid crystal display panel that is shown in FIG. 1A.

A TFT liquid crystal display device is an example of the display device according to the present invention. As shown in FIG. 1A, the TFT liquid crystal display device includes a liquid crystal display panel 1 having plural scanning signal lines GL and plural video signal lines DL, a data driver 2, a gate driver 3, and a control circuit 4. The data driver 2 is a drive circuit that generates the video signal (which may be referred to as a tone voltage signal) to be applied to each video signal line DL of the liquid crystal display panel 1. The gate driver 3 is a drive circuit that generates the scanning signal to be applied to each scanning signal line GL of the liquid crystal display panel 1. The control circuit 4 controls the operation of the data driver 2 and the operation of the gate driver 3.

In addition to the liquid crystal display panel 1, data driver 2, gate driver 3, and control circuit 4, the TFT liquid crystal display device obviously includes some other circuit components that are not shown in FIG. 1A. If, for instance, the TFT liquid crystal display device is of a transmissive type or of a semi-transmissive type, it includes a light source called a backlight unit.

A display area DA of the liquid crystal display panel 1 is composed of plural pixels that are arranged in a matrix format. The size of one pixel corresponds to the size of a region that is enclosed by two neighboring scanning signal lines GL and two neighboring video signal lines DL. Each pixel has a TFT, which is an active element (which may be referred to as a switching element), and a pixel electrode that is connected to the source of the TFT. The drain of the TFT is connected to one of the two video signal lines DL while the pixel electrode connected to the source of the TFT is sandwiched between the two video signal lines DL. The gate of the TFT is connected to one of the two scanning signal lines GL while the pixel electrode connected to the source of the TFT is sandwiched between the two scanning signal lines GL. In other words, a pixel electrode positioned between two neighboring video signal lines DL is connected to one of the two neighboring video signal lines DL through a TFT.

In the liquid crystal display panel 1 of the TFT liquid crystal display device according to the present invention, plural pixel electrodes are positioned between two neighboring video signal lines DL and arranged in the extending direction of the video signal lines DL. These pixel electrodes are configured so that a pixel electrode connected to one of the two neighboring video signal lines DL through a TFT and a pixel electrode PX connected to the other video signal line DL through a TFT are alternately arranged in the extending direction of the video signal lines DL.

More specifically, as shown in FIG. 1B, in the liquid crystal display panel 1 of the TFT liquid crystal display device according to the present invention, plural pixel electrodes PX are positioned, for instance, between two neighboring video signal lines $DL_m$, $DL_{m+1}$ and arranged in the extending direction of the video signal lines DL. These pixel electrodes PX are configured so that a pixel electrode PX connected to the video signal line $DL_{m+1}$ through a TFT and a pixel electrode PX connected to the video signal line $DL_m$ through a TFT are alternately arranged.

Referring to FIG. 1B, a line $HL_n$ of a pixel electrode PX positioned between two scanning signal lines $GL_{n-1}$, $GL_n$ is a line of a pixel electrode into which the video signal applied to each video signal line DL is to be written while a scanning signal applied to the scanning signal line $GL_n$ is ON. A line $HL_{n+1}$ of a pixel electrode PX positioned between two scanning signal lines $GL_n$, $GL_{n+1}$ is a line of a pixel electrode into which the video signal applied to each video signal line DL is to be written while a scanning signal applied to the scanning signal line $GL_{n+1}$ is ON. A line $HL_{n+2}$ of a pixel electrode PX positioned between two scanning signal lines $GL_{n+1}$, $GL_{n+2}$ is a line of a pixel electrode into which the video signal applied to each video signal line DL is to be written while a scanning signal applied to the scanning signal line $GL_{n+2}$ is ON.

FIG. 1B schematically shows the configuration of fifteen pixels (five horizontal pixels×three vertical pixels). When the liquid crystal display panel 1 is an RGB color liquid crystal display panel, each pixel is generally called a sub-pixel. Three pixels, namely, R (red), G (green), and B (blue) pixels, are arranged in the extending direction of the scanning signal lines GL to display one dot of a motion picture or still picture.

In an example shown in FIG. 1B, a column $G_{u-1}$ of pixel electrodes PX between two video signal lines $DL_{m-2}$, $DL_{m-1}$ and a column $G_u$ of pixel electrodes PX between two video signal lines $DL_{m+1}$, $DL_{m+2}$ are columns of pixel electrodes for pixels that display the tone of G (green). A column $B_{u-1}$ of pixel electrodes PX between two video signal lines $DL_{m-1}$, $DL_m$ and a column $B_u$ of pixel electrodes PX between two video signal lines $DL_{m+2}$, $DL_{m+3}$ are columns of pixel electrodes for pixels that display the tone of B (blue). A column $R_u$ of pixel electrodes PX between two video signal lines $DL_m$, $DL_{m+1}$ is a column of pixel electrodes for pixels that display the tone of R (red).

Referring to FIG. 1B, a pixel having a pixel electrode in the pixel electrode column $R_u$, a pixel having a pixel electrode in the pixel electrode column $G_u$, and a pixel having a pixel electrode in the pixel electrode column $B_u$, which are included in a line $HL_n$ of five pixel electrodes PX between two scanning signal lines $GL_{n-1}$, $GL_n$, form one dot of a motion picture or still picture.

In a TFT liquid crystal display device having the liquid crystal display panel 1 that is configured as shown in FIG. 1B, a video signal having a positive polarity is applied to one of two neighboring video signal lines and a video signal have a negative polarity is applied to the other video signal line when, for instance, the data driver 2 applies a video signal to each video signal line DL. The positive polarity and negative polarity are based on the relationship between the potential of a pixel electrode in which a video signal is written and the potential of a counter electrode. A video signal related to a pixel electrode whose potential is higher than that of a common voltage is referred to as a video signal having a positive polarity, whereas a video signal related to a pixel electrode whose potential is lower than that of the common voltage is referred to as a video signal having a negative polarity.

When, for instance, a video signal having a negative polarity is applied to one $DL_m$ of two neighboring video signal lines $DL_m$, $DL_{m+1}$ and a video signal having a negative polarity is applied to the other video signal line $DL_{m+1}$, the pixel electrodes between the video signal lines $DL_m$, $DL_{m+1}$ are configured so that a pixel electrode having a positive polarity (+) and a pixel electrode having a negative polarity (−) are alternately arranged.

In the above instance, plural pixel electrodes PX arranged in the extending direction of the scanning signal lines GL, namely, the pixel electrodes PX positioned, for instance, between two neighboring scanning signal lines $GL_n$, $GL_{n+1}$, are also configured so that a pixel electrode having a positive polarity (+) and a pixel electrode having a negative polarity (−) are alternately arranged.

In other words, the TFT liquid crystal display device according to the present invention can implement a so-called dot inversion method by using a so-called column inversion method.

However, the TFT liquid crystal display device according to the present invention might allow a phenomenon called "lateral stripes" to occur to the detriment of image quality. One of the factors causing the phenomenon called "lateral stripes" will now be briefly described with reference to FIGS. 2A and 2B.

Figure 2A:
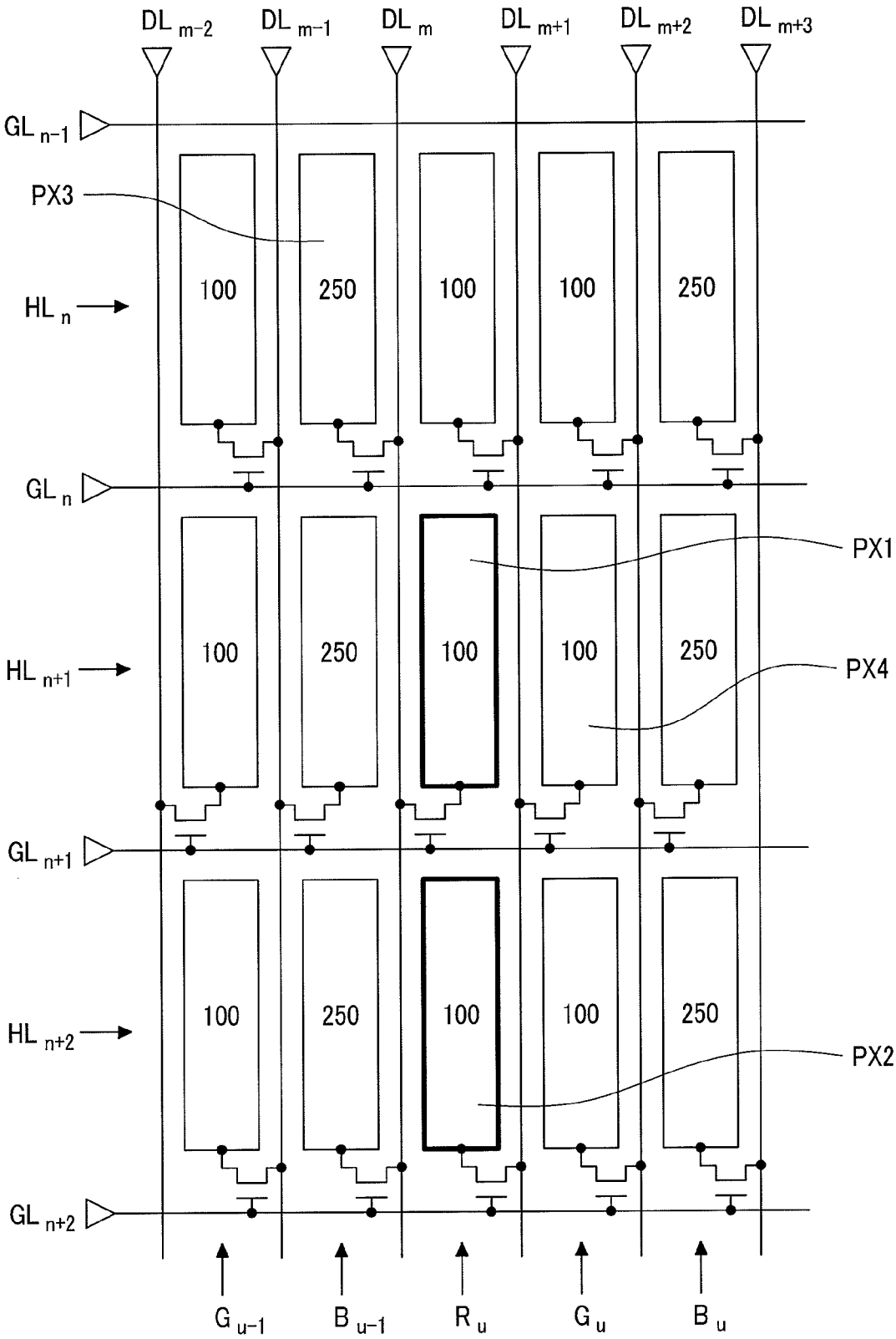
FIG. 2A is a schematic circuit diagram illustrating typical tones of pixels of a TFT liquid crystal display device according to the present invention.
Figure 2B:
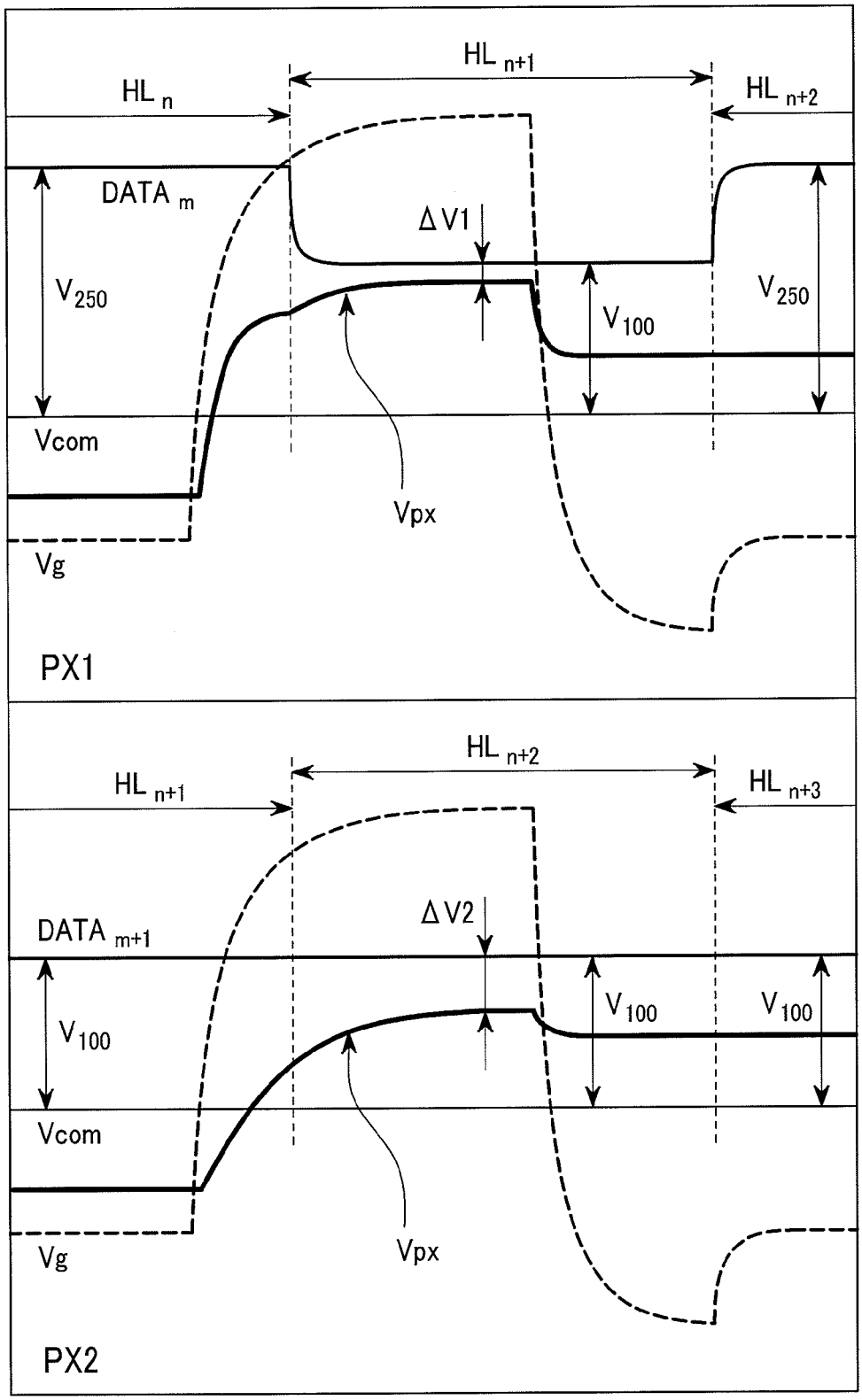
FIG. 2B is a set of schematic waveform diagrams illustrating typical tone voltages to be written into two pixel electrodes PX1, PX2 shown in FIG. 2A.

FIGS. 2A and 2B are schematic diagrams illustrating one of the problems with the TFT liquid crystal display device according to the present invention.

FIG. 2A is a schematic circuit diagram illustrating typical tones of pixels of the TFT liquid crystal display device according to the present invention. FIG. 2B is a set of schematic waveform diagrams illustrating typical tone voltages to be written into two pixel electrodes PX1, PX2 shown in FIG. 2A.

When a motion picture or still picture is to be displayed on the liquid crystal display panel 1 of the TFT liquid crystal display device according to the present invention, tone video signals (tone voltages) having, for instance, numerical values indicated for the pixel electrodes PX shown in FIG. 2A may be written into the pixel electrodes PX for various pixels. More specifically, a tone voltage corresponding to 100 red/green color tone may be written into pixel electrodes PX for pixels displaying an R (red) tone and pixel electrodes PX for pixels displaying a G (green) tone, whereas atone voltage corresponding to 250 blue color tone may be written into pixel electrodes PX for pixels displaying a B (blue) tone.

In the above instance, a video signal $DATA_m$ is applied, for instance, to a video signal line $DL_m$ between two neighboring pixel electrode columns $B_{u-1}$, $R_u$. The video signal $DATA_m$ alternates between a video signal having a voltage $V_{250}$ corresponding to 250 blue color tone to be written into a pixel electrode PX in the column $B_{u-1}$ and a video signal having a voltage $V_{100}$ corresponding to 100 red color tone to be written into a pixel electrode PX in the column $R_u$, as shown in the upper half of FIG. 2B. In $DATA_m$ in a waveform diagram shown in the upper half of FIG. 2B, the three periods $HL_n$, $HL_{n+1}$, $HL_{n+2}$ are periods during which video signals to be written into the pixel electrodes PX in the lines $HL_n$, $HL_{n+1}$, $HL_{n+2}$ shown in FIG. 2A are applied.

When a video signal having a voltage $V_{100}$ corresponding to 100 red color tone is to be written into a pixel electrode PX1 in line $HL_{n+1}$, column $R_u$, the relationship between the waveform of a scanning signal Vg, the waveform of a common voltage Vcom, the waveform of the voltage Vpx of pixel electrode PX1, and the waveform of video signal $DATA_m$ applied to the video signal line $DL_m$ is as shown, for instance, in the upper half of FIG. 2B. More specifically, the voltage Vpx of pixel electrode PX1 sharply rises due, for instance, to the influence of the voltage $V_{250}$ of the video signal to be written into pixel electrode PX3, which precedes pixel electrode PX1, immediately after the scanning signal Vg of scanning signal line $GL_{n+1}$ turns ON. In the resulting state, the video signal having the original voltage $V_{100}$ is written. As a result, there is a small potential difference ΔV1 between the voltage actually written into pixel electrode PX1 and the tone voltage for pixel electrode PX1 that is related to the video signal $DATA_m$ when the scanning signal Vg begins to fall.

Meanwhile, a video signal $DATA_{m+1}$ is applied to a video signal line $DL_{m+1}$ between two neighboring pixel electrode columns $R_u$, $G_u$. The video signal $DATA_{m+1}$ alternates between a video signal having a voltage $V_{100}$ corresponding to 100 red color tone to be written into a pixel electrode PX in the column $R_u$ and a video signal having a voltage $V_{100}$ corresponding to 100 green color tone to be written into a pixel electrode PX in the column $G_u$, as shown in the lower half of FIG. 2B. In $DATA_{m+1}$ in a waveform diagram shown in the lower half of FIG. 2B, the three periods $HL_{n+1}$, $HL_{n+2}$, $HL_{n+3}$ are periods during which video signals to be written into the pixel electrodes PX in the lines $HL_{n+1}$, $HL_{n+2}$ shown in FIG. 2A and in a line $HL_{n+3}$ (not shown) are applied.

When a video signal having a voltage $V_{100}$ corresponding to 100 red color tone is to be written into a pixel electrode PX2 in line $HL_{n+2}$, column $R_u$, the relationship between the waveform of the scanning signal Vg, the waveform of the common voltage Vcom, the waveform of the voltage Vpx of pixel electrode PX2, and the waveform of video signal $DATA_{m+1}$ applied to the video signal line $DL_{m+1}$ is as shown, for instance, in the lower half of FIG. 2B. More specifically, the voltage Vpx of pixel electrode PX2 gradually rises due, for instance, to the influence of the voltage $V_{100}$ of the video signal to be written into pixel electrode PX4, which precedes pixel electrode PX2, immediately after the scanning signal Vg of scanning signal line $GL_{n+2}$ turns ON. In the resulting state, the video signal having the original voltage $V_{100}$ is written. As a result, the potential difference ΔV2 between the voltage actually written into pixel electrode PX2 and the tone voltage $V_{100}$ for pixel electrode PX2 that is related to the video signal $DATA_{m+1}$ when the scanning signal Vg begins to fall is greater than the potential difference ΔV1 between the voltage actually written into pixel electrode PX1 and the tone voltage $V_{100}$ for pixel electrode PX1 that is related to the video signal $DATA_m$.

Since pixel electrodes PX1 and PX2 are both in column $R_u$, the voltage $V_{100}$ corresponding to the 100 red color tone should be written. In reality, however, the potential difference ΔV1 between the tone voltage $V_{100}$ for the video signal $DATA_m$ applied to the video signal line $DL_m$ and the voltage actually written into pixel electrode PX1 is different from the potential difference ΔV2 between the tone voltage $V_{100}$ for the video signal $DATA_{m+1}$ applied to the video signal line $DL_{m+1}$ and the voltage actually written into pixel electrode PX2 as shown in FIG. 2B. In other words, pixel electrode PX1, which is connected to video signal line $DL_m$ through a TFT, and pixel electrode PX2, which is connected to video signal line $DL_{m+1}$ through a TFT, differ in written voltage insufficiency.

In a conventional TFT liquid crystal display device, therefore, the tone (brightness) of a pixel having pixel electrode PX1 and the tone (brightness) of a pixel having pixel electrode PX2 take on different values. As a result, the phenomenon called "lateral stripes" occurred to the detriment of image quality.

The tone values for various pixel electrodes shown in FIG. 2A are based on a combination that makes the phenomenon called "lateral stripes" obvious. A different tone value combination also causes the phenomenon called "lateral stripes." FIG. 2A assumes that plural pixel electrodes in plural columns for displaying the same color, namely, the pixel electrodes, for instance, in column $B_{u-1}$ and pixel electrodes, for instance, in column $B_u$, have the same tone value. However, the phenomenon called "lateral stripes" also occurs even when the pixel electrodes in various columns have different tone values. Further, FIG. 2A assumes that plural pixel electrodes in the same column, namely, the pixel electrodes in, for instance, column $R_u$, have the same tone value. However, the phenomenon called "lateral stripes" also occurs even when the pixel electrodes in the same column have different tone values.

Methods used by a TFT liquid crystal display device having the liquid crystal display panel 1 configured as shown in FIG. 1B to avoid image quality deterioration by suppressing the phenomenon called "lateral stripes" will now be described.

First Embodiment

Figure 3A:
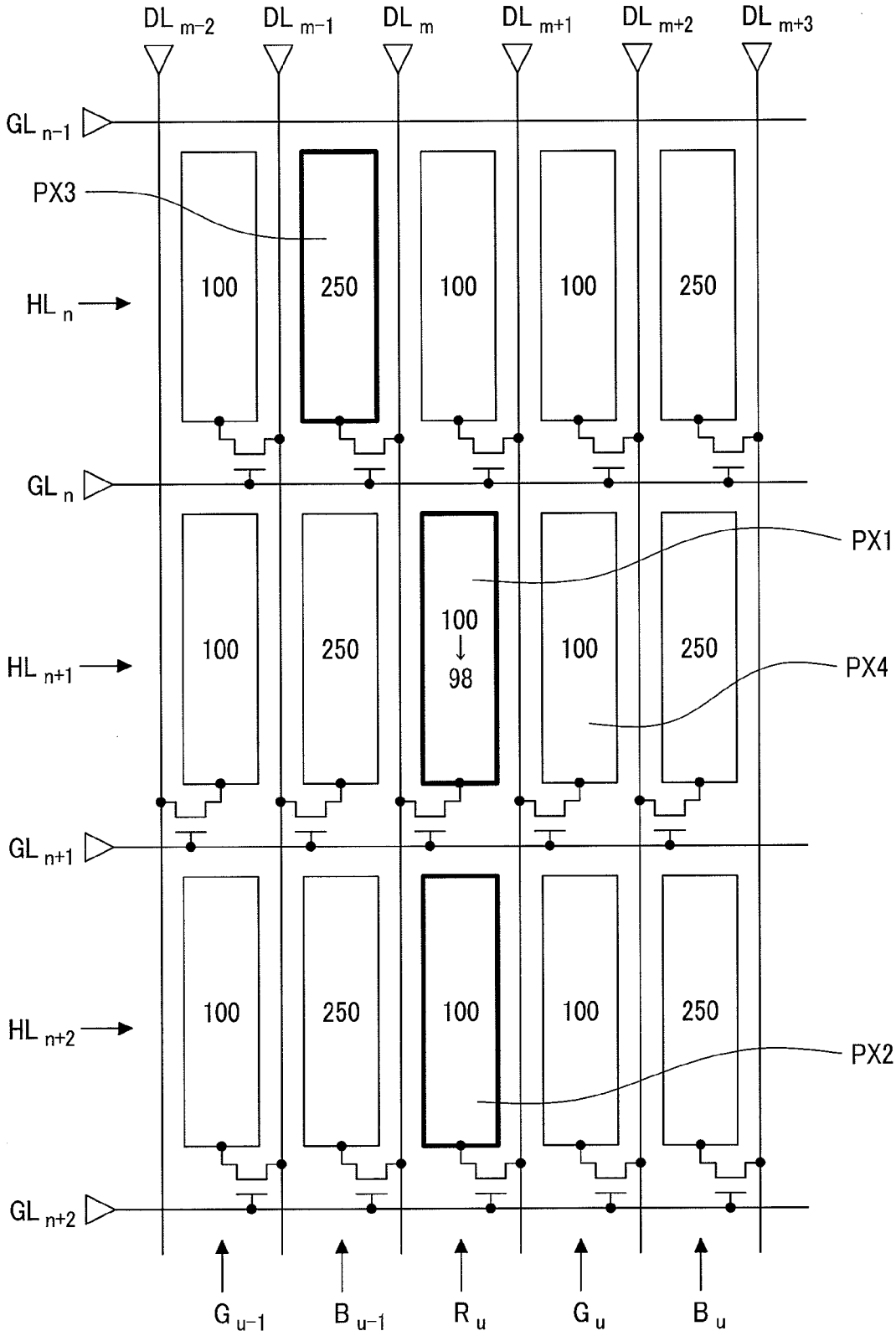
FIG. 3A is a schematic circuit diagram outlining a method for driving a liquid crystal display device according to a first embodiment of the present invention.
Figure 3B:
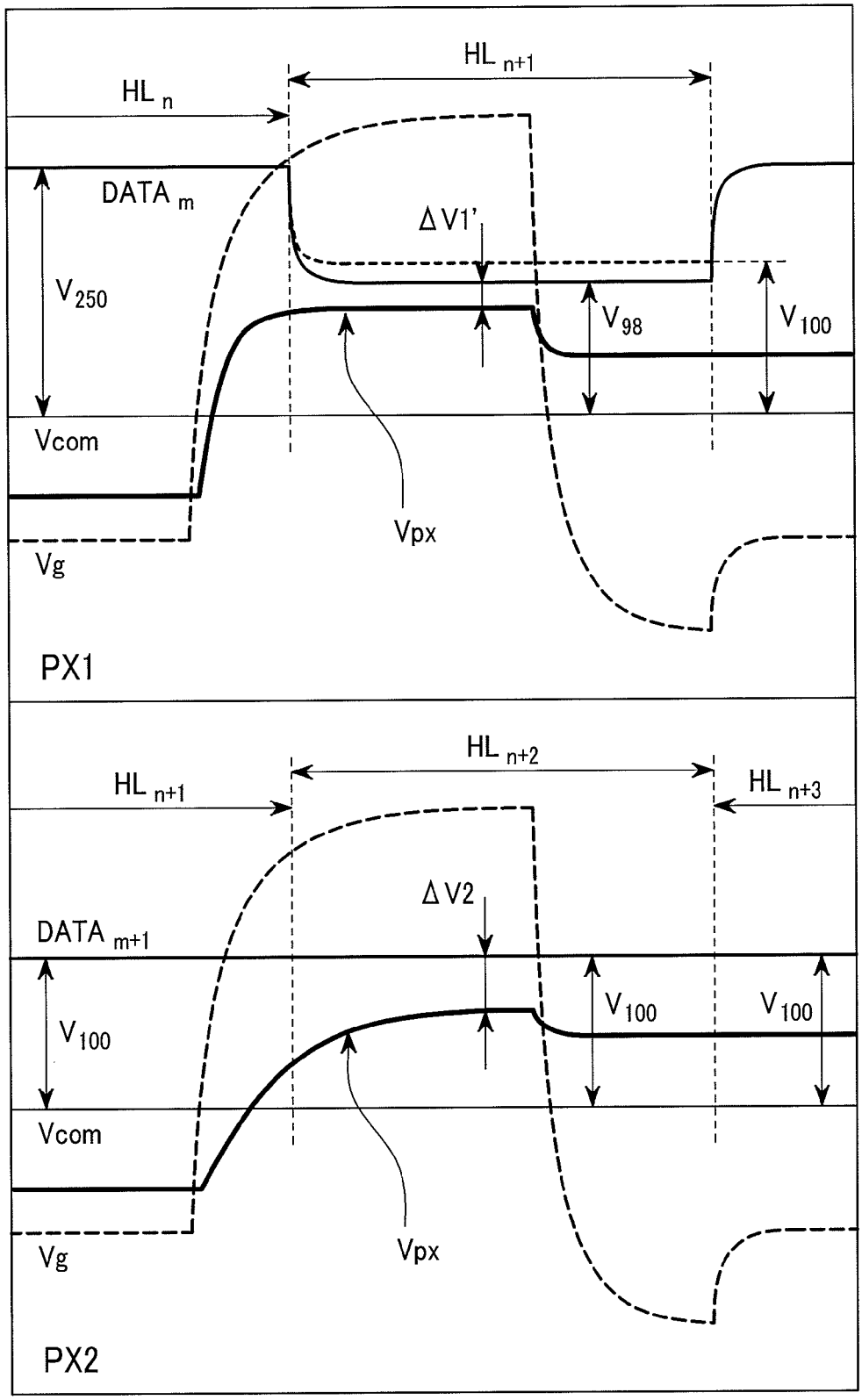
FIG. 3B is a set of schematic waveform diagrams illustrating typical tone voltages to be written into two pixel electrodes PX1, PX2 shown in FIG. 3A.

FIGS. 3A and 3B are schematic diagrams illustrating a typical method for driving the TFT liquid crystal display device according to a first embodiment of the present invention.

FIG. 3A is a schematic circuit diagram outlining the method for driving the liquid crystal display device according to the first embodiment. FIG. 3B is a set of schematic waveform diagrams illustrating typical tone voltages to be written into two pixel electrodes PX1, PX2 shown in FIG. 3A.

The first embodiment corrects the tone of the video signal to be written into pixel electrode PX1 in accordance with the tone difference between the video signal for pixel electrode PX1 and the video signal, for instance, for pixel electrode PX3 in line $HL_n$, column $B_{u-1}$ namely, the preceding pixel electrode connected to the video signal line $DL_m$ to which pixel electrode PX1 is connected through a TFT for the purpose reducing the difference between, for instance, the insufficiency ΔV1 of a tone voltage written into pixel electrode PX1, which is shown in FIG. 2A, and the insufficiency ΔV2 of a tone voltage written into pixel electrode PX2.

More specifically, the video signal (tone voltage) to be written into one of plural pixel electrodes PX connected to a certain video signal line DL through a TFT is corrected in accordance with the tone difference from the video signal to be written into a pixel electrode PX that is positioned toward the signal input end and precedes the aforementioned one of the plural pixel electrodes PX. In this instance, the tone of the target pixel electrode PX is corrected in accordance with a correction table that looks like Table 1 below.

TABLE 1

An example of connection table

| | |
|---|---|
| $\Delta K = K_{n+1} - K_n$ | $K_{n+1}'$ |
| $\Delta K \geqq 100$ | $K_{n+1} + 2$ |
| $100 > \Delta K \geqq 50$ | $K_{n+1} + 1$ |
| $50 > \Delta K > -50$ | $K_{n+1}$ |
| $-50 \geqq \Delta K > -100$ | $K_{n+1} - 1$ |
| $-100 \geqq \Delta K$ | $K_{n+1} - 2$ |

In table 1, $K_{n+1}$ is an uncorrected tone of the video signal to be written into the target pixel electrode PX and $K_{n+1}'$ is a corrected tone. $K_n$ is an uncorrected tone of a video signal line that is to be written into a pixel electrode PX preceding the target pixel electrode PX.

If, in the example shown in Table 1, the difference ΔK between the uncorrected tone $K_{n+1}$ of the video signal to be written into the target pixel electrode PX and the uncorrected tone $K_n$ of the video signal to be written into the preceding pixel electrode PX is, for instance, not greater than −100, the video signal to be written into the target pixel electrode PX is corrected to a $(K_{n+1}-2)$ tone. When the tone shown in FIG. 2A is used for display purposes, the difference ΔK between the tone of the video signal to be written into pixel electrode PX1, which is in line $HL_{n+1}$, column $R_u$, and the tone of the video signal to be written into pixel electrode PX3, which precedes pixel electrode PX1 and is in line $HL_n$, column $B_{u-1}$, is ΔK=100-250=−150. Therefore, when a tone correction is to be made in accordance with the correction table shown in Table 1, the tone of a video signal to be written into pixel electrode PX1 is changed from 100 tone to 98 tone as shown in FIG. 3A. In FIG. 3A, the triangular marks at the upper ends of video signal lines $DL_{m-2}$, $DL_{m-1}$, $DL_m$, $DL_{m+1}$, $DL_{m+2}$, and $DL_{m+3}$ represent a signal input end.

In the above situation, the relationship between the waveforms of tone voltages Vpx to be written into two pixel electrodes PX1, PX2 shown in FIG. 3A, the waveform of the scanning signal Vg, the waveform of the common voltage Vcom, the waveforms of voltages Vpx to be written into the pixel electrodes, and the waveform of the video signal $DATA_m$ applied to the video signal line $DL_m$ is as shown in FIG. 3B.

In the above instance, the potential difference ΔV1' between the voltage Vpx written into pixel electrode PX1 and the tone voltage of the video signal $DATA_m$ (namely, written voltage insufficiency) is a potential difference that prevails when a video signal having a voltage $V_{98}$ corresponding to 98 tone is written. Therefore, the potential difference between the video signal having a voltage $V_{100}$ corresponding to 100 tone, which is indicated by broken lines in FIG. 3B, and the voltage Vpx written into pixel electrode PX1 with a 98 tone video signal is greater than the potential difference ΔV1 shown in FIG. 2B.

Meanwhile, the tone of the uncorrected video signal to be written into pixel electrode PX2 and the tone of the uncorrected video signal to be written into the preceding pixel electrode PX4 are both 100 tone. Therefore, the tone of the video signal for pixel electrode PX2 continues to be 100 tone when the correction table shown in Table 1 is complied with. Thus, the waveform of the tone voltage Vpx to be written into pixel electrode PX2 is the same as the waveform shown in the lower half of FIG. 2B. Consequently, the potential difference between the tone voltage $V_{100}$ of the video signal $DATA_{m+1}$ and the voltage Vpx written into pixel electrode PX2 is equal to the potential difference Δ2 shown in FIG. 2B.

Therefore, when the method for driving the TFT liquid crystal display device according to the first embodiment is used, the difference ($\Delta V2-\Delta V1'$) between the potential difference $\Delta V1'$ between the tone voltage of the video signal $DATA_m$ prevailing when the scanning signal Vg begins to fall and the voltage actually written in pixel electrode PX1 and the potential difference $\Delta V2$ between the tone voltage of the video signal $DATA_{m+1}$ prevailing when the scanning signal Vg begins to fall and the voltage actually written into pixel electrode PX2 is smaller than $\Delta V2-\Delta V1$. This reduces the difference between the tone (brightness) of a pixel having pixel electrode PX1 and the tone (brightness) of a pixel having pixel electrode PX2, thereby making it possible to avoid image quality deterioration due to the occurrence of a phenomenon called "lateral stripes."

Figure 4A:
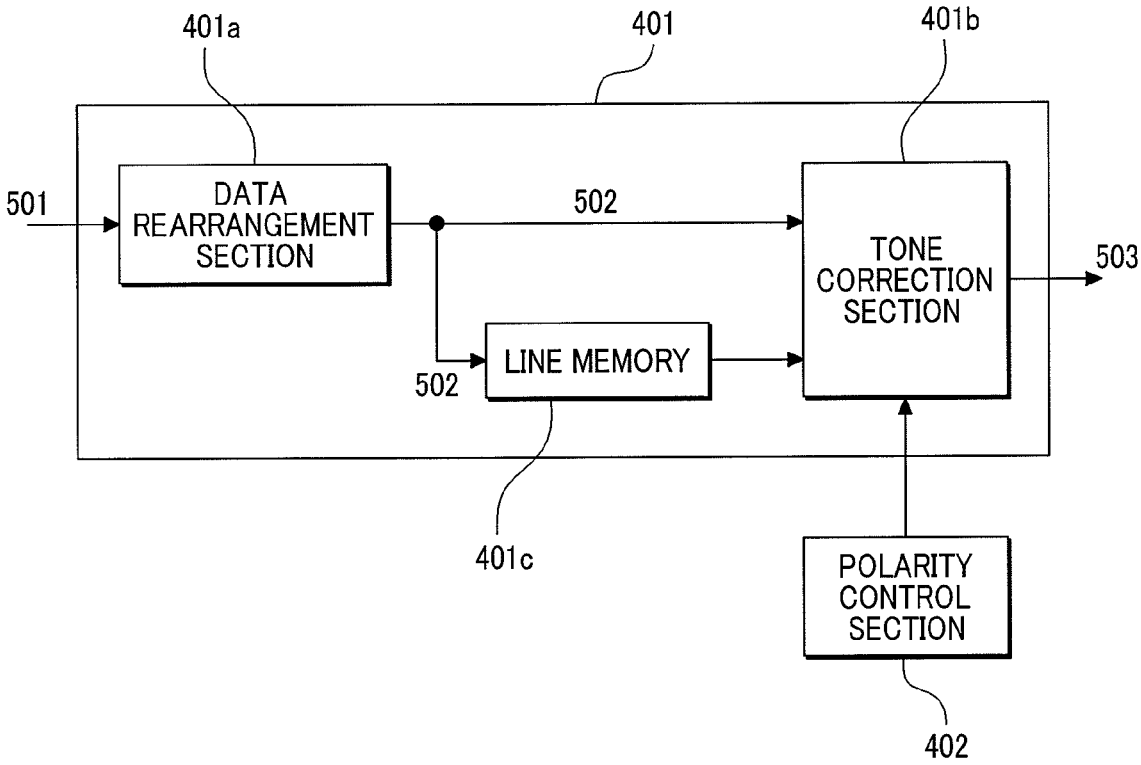
FIG. 4A is a schematic block diagram illustrating a typical configuration of a correction circuit in a TFT liquid crystal display device according to the first embodiment of the present invention.
Figure 4B:
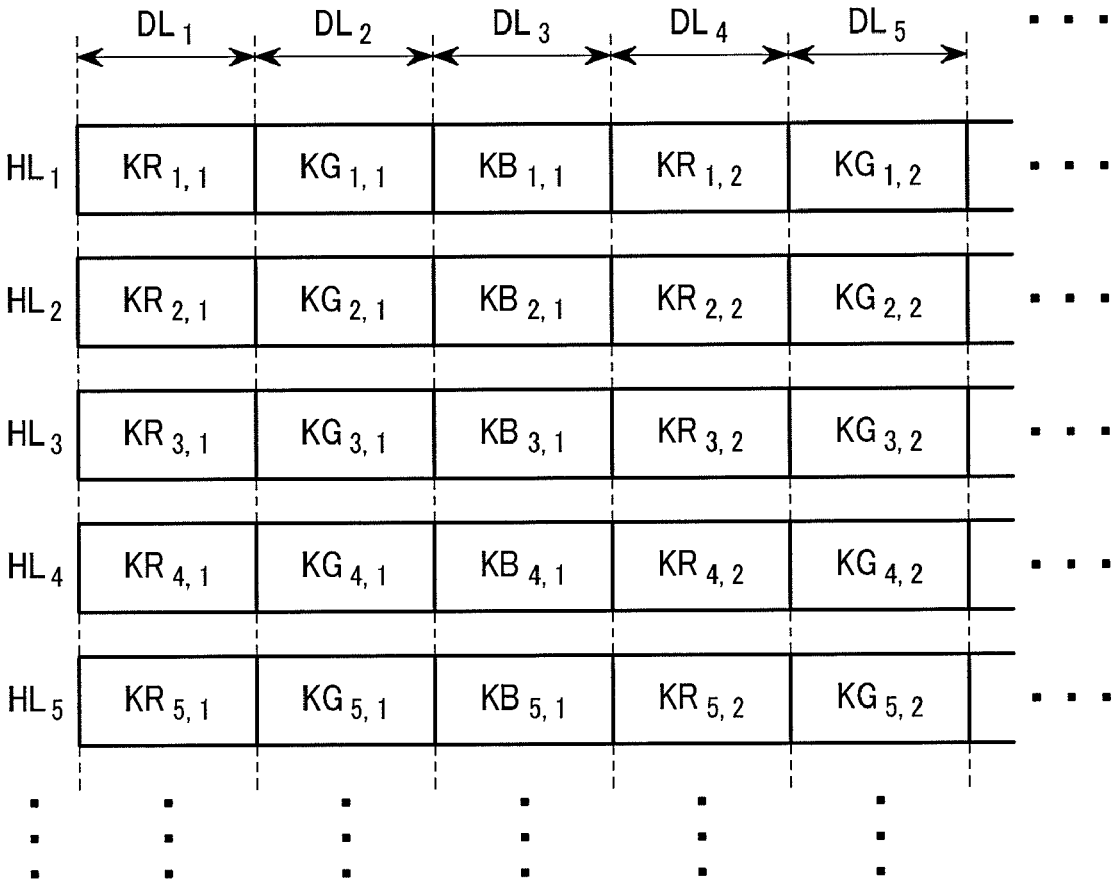
FIG. 4B is a schematic diagram illustrating an example of video data to be input into the correction circuit.
Figure 4C:
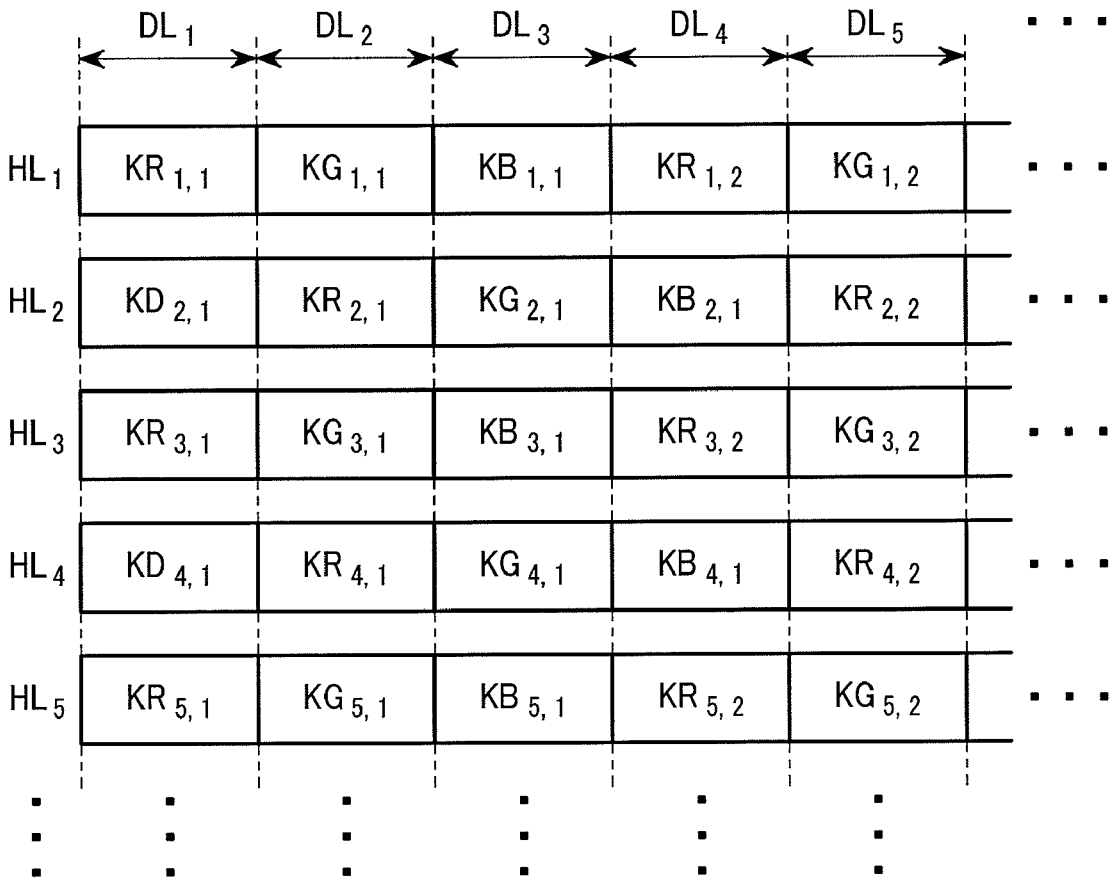
FIG. 4C is a schematic diagram illustrating an example of video data that has been rearranged by a data rearrangement section of the correction circuit.

FIGS. 4A to 4C are schematic diagrams outlining a typical configuration of the TFT liquid crystal display device that implements the drive method according to the first embodiment.

FIG. 4A is a schematic block diagram illustrating a typical configuration of a correction circuit in the TFT liquid crystal display device according to the first embodiment. FIG. 4B is a schematic diagram illustrating an example of video data to be input into the correction circuit. FIG. 4C is a schematic diagram illustrating an example of video data that has been rearranged by a data rearrangement section of the correction circuit.

The method for driving the TFT liquid crystal display device according to the first embodiment can be implemented when, for instance, a correction circuit 401 configured as shown in FIG. 4A is added to the control circuit 4 shown in FIG. 1A. The correction circuit 401 includes, for instance, a data rearrangement section 401*a*, a tone correction section 401*b*, and a line memory 401*c*.

Video data 501 input into the TFT liquid crystal display device is in a format that is shown, for instance, in FIG. 4B. The video signal for each video signal line DL is made of a tone voltage that is to be written into plural pixel electrodes PX between two neighboring video signal lines. More specifically, the video signal to be applied to a video signal line $DL_m$ includes tone data $Kc_{n,m}$ (c=R, G, or B; n=1, 2, 3, . . . , N) to be written into each pixel electrode PX between two video signal lines $DL_m$, $DL_{m+1}$. As such being the case, the data rearrangement section 401*a* first rearranges the video data 502 into a format that looks, for instance, like FIG. 4C. $KD_{2,1}$ and $KD_{4,1}$, which are tone data for video signal line $DL_1$, are dummy video signals. $KD_{2,1}$ has the same tone data as $KR_{1,1}$, whereas $KD_{4,1}$ has the same tone data as $KR_{3,1}$.

The video data 502 rearranged by the data rearrangement section 401 is transferred to the tone correction section 401*b* and line memory 401*c* one line $HL_n$ after another. The tone correction section 401*b* compares the tone data to be written into each pixel electrode in line $HL_n$ against the tone data to be written into each pixel electrode in line $HL_{n-1}$, and corrects the tone data to be written into each pixel electrode in line $HL_n$ in accordance with a correction table that looks like Table 1 and with a polarity identifier (positive polarity or negative polarity) derived from a polarity control section 402. The corrected video data 503 is then transferred to the data driver 2 to generate the video signal (tone voltage signal) to be applied to each video signal line DL. Next, the video signal is applied to each video signal line DL in accordance with a timing signal (clock signal) controlled, for instance, by the control circuit 4 while the scanning signals to be applied to the scanning signal lines GL are sequentially turned ON. In this manner, the liquid crystal display panel 1 displays one frame period of motion picture or still picture.

The correction circuit 401 shown in FIG. 4A is an example of a circuit configuration for implementing the drive method according to the first embodiment. It goes without saying that an alternative configuration may be used as far as the tone of the video signal to be written into each pixel electrode PX can be corrected by the method described with reference to FIGS. 3A and 3B and Table 1.

As described above, the TFT liquid crystal display device and its drive method according to the first embodiment make it possible to avoid image quality deterioration of the TFT liquid crystal display device by suppressing the phenomenon called "lateral stripes."

As indicated in Table 1 above, the first embodiment assumes that corrections are made through the use of the correction table based on five different ranges of tone difference $\Delta K$ between two pixel electrodes ($\Delta K \geqq 100$, $100>\Delta K \geqq 50$, $50>\Delta K>-50$, $-50 \geqq \Delta K>-100$, and $-100 \geqq \Delta K$). Alternatively, however, the correction table may be based on five ranges that are defined by values other than the above-mentioned ones. Another alternative is to use the correction table based on six or more ranges.

Figure 5A:
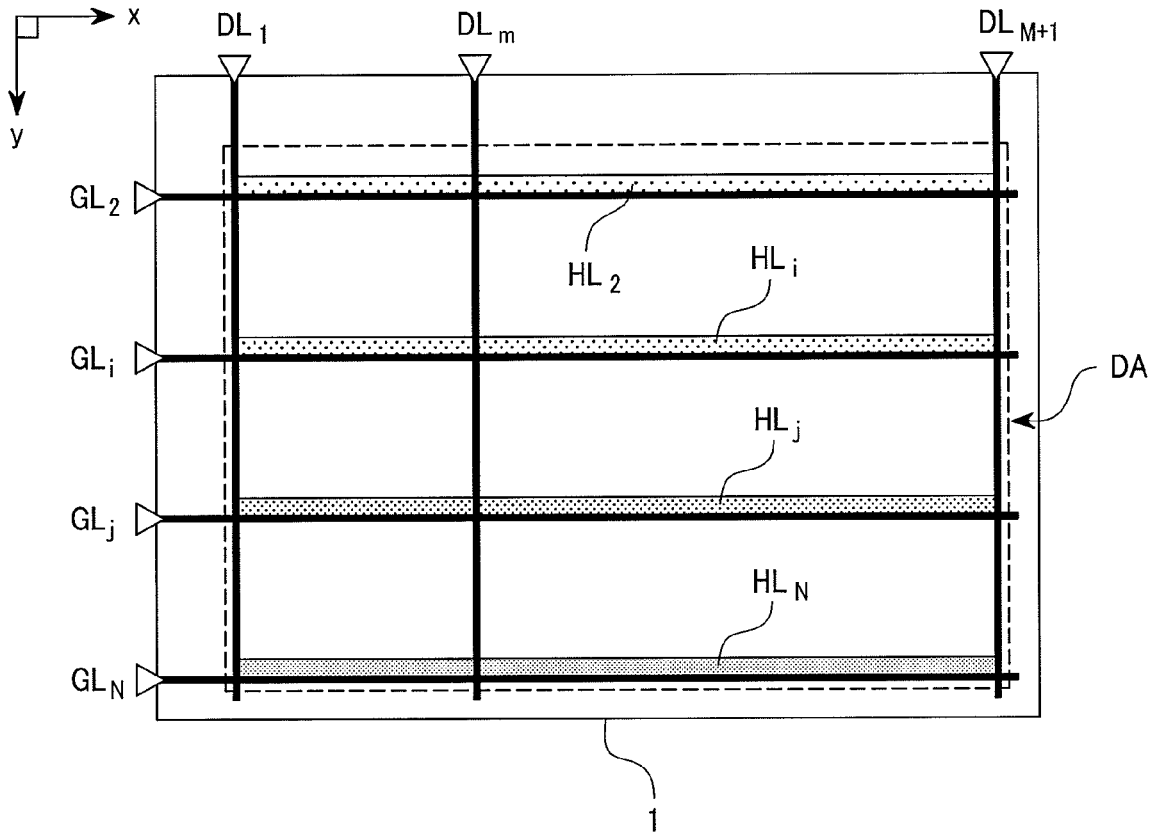
FIG. 5A is a schematic diagram illustrating the tendency of a phenomenon called "lateral stripes"
Figure 5B:
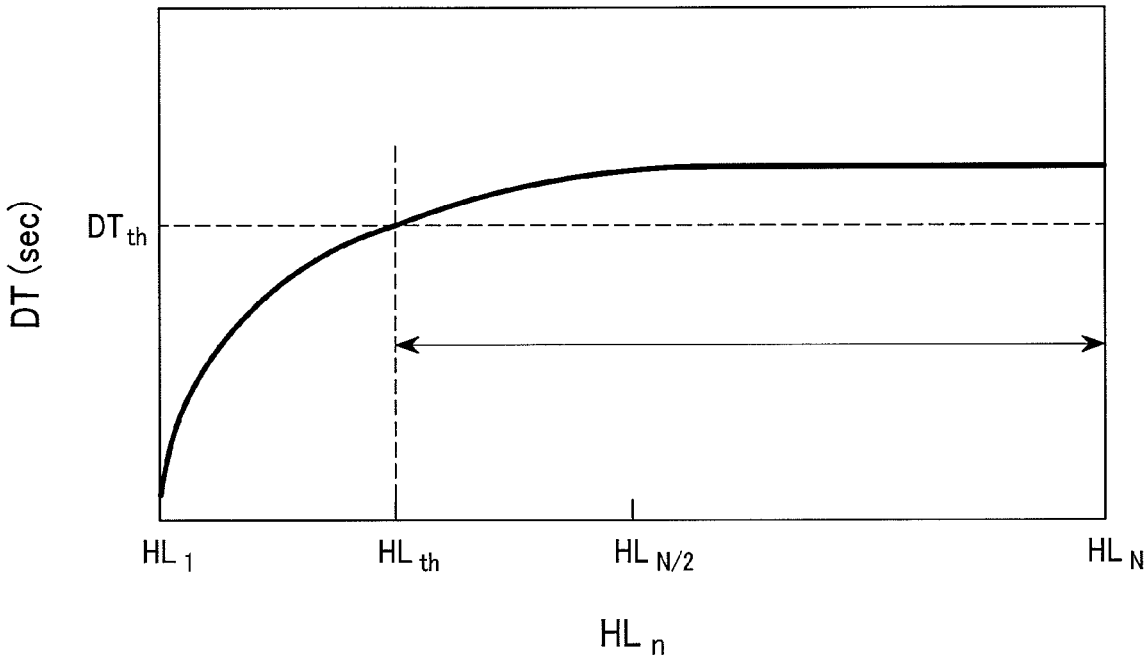
FIG. 5B is a schematic graph illustrating a first modification of a tone correction method.
Figure 5C:
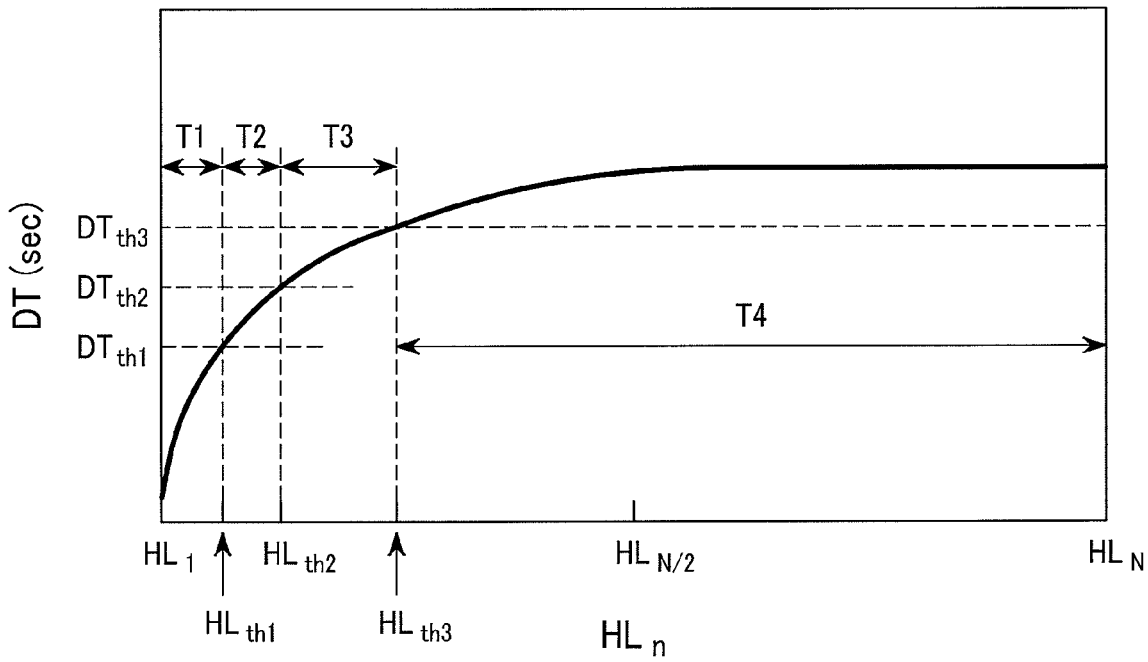
FIG. 5C is a schematic graph illustrating a second modification of the tone correction method.

FIGS. 5A to 5C are schematic diagrams illustrating modifications of the first embodiment.

FIG. 5A is a schematic diagram illustrating the tendency of the phenomenon called "lateral stripes." FIG. 5B is a schematic graph illustrating a first modification of the tone correction method. FIG. 5C is a schematic graph illustrating a second modification of the tone correction method.

The level (visibility) of the phenomenon called "lateral stripes," which occurs when the TFT liquid crystal display device configured as shown in FIG. 1B is driven by a conventional method, varies with the line as shown in FIG. 5A depending, for instance, on whether the line is line $HL_2$, which is close to the signal input end of a video signal line DL, line $HL_N$, which is the farthest from the signal input end of the video signal line DL, or line $HL_i$ or $HL_j$, which are positioned between lines $HL_2$ and $HL_N$. In general, the phenomenon called "lateral stripes" is not so obvious near line $HL_2$, which is close to the signal input end of the video signal line DL, and the visibility of the phenomenon increases with an increase in the distance from the signal input end of the video signal line DL. In FIG. 5A, the triangular marks at the upper ends of video signal lines $DL_1$, $DL_m$, and $DL_{m+1}$ represent a signal input end.

The visibility of lateral stripes, which increases with an increase in the distance from the signal input end of a video signal line DL as described above, partly depends on the amount of delay of a video signal applied to each video signal line DL.

Therefore, when the TFT liquid crystal display device is to be driven by the method described in conjunction with the first embodiment, only the pixels between line $HL_{th}$ and line $HL_N$, for which the delay time DT of the video signal is longer than a threshold value $DT_{th}$, may be subjected to tone data correction described above as indicated, for instance, in FIG. 5B. In the graph shown in FIG. 5B, the horizontal axis indicates lines $HL_n$. This graph assumes that line $HL_1$ is the closest to the signal input end of a video signal line while line $HL_N$ is the farthest from the signal input end of the video signal line. The vertical axis of the graph indicates the delay time DT (sec) of the video signal. The delay time increases along the vertical axis.

When the TFT liquid crystal display device is to be driven by the method described above, it goes without saying that the delay time threshold value $DT_{th}$, that is, the correction start line $HL_{th}$, can be changed as needed.

When the TFT liquid crystal display device is driven by the method described above, tone data corrections can also be made, for instance, for pixels between line $HL_1$ and line $HL_{th-1}$, for which the delay time is shorter than the threshold vale $DT_{th}$. In such an instance, a correction table, for instance, for pixels between line $HL_1$ and line $HL_{th-1}$ and a correction table, for instance, for pixels between line $HL_{th}$ and line $HL_N$ should be prepared.

Further, when threshold value setup is to be performed for the video signal delay time DT, an alternative is to set a first threshold value $DT_{th1}$, a second threshold value $DT_{th2}$, and a third threshold value $DT_{th3}$, and correct the tone data of pixels in each line $HL_n$ in accordance with correction tables T1, T2, T3, and T4, which are formulated for four different ranges defined by the above three threshold values as indicated, for instance, in FIG. 5C.

The example shown in FIG. 5C assumes that three threshold values $DT_{th1}$, $DT_{th2}$, $DT_{th3}$ are set. However, it goes without saying that an alternative would be to set two threshold values or four or more threshold values.

Second Embodiment

Figure 6A:
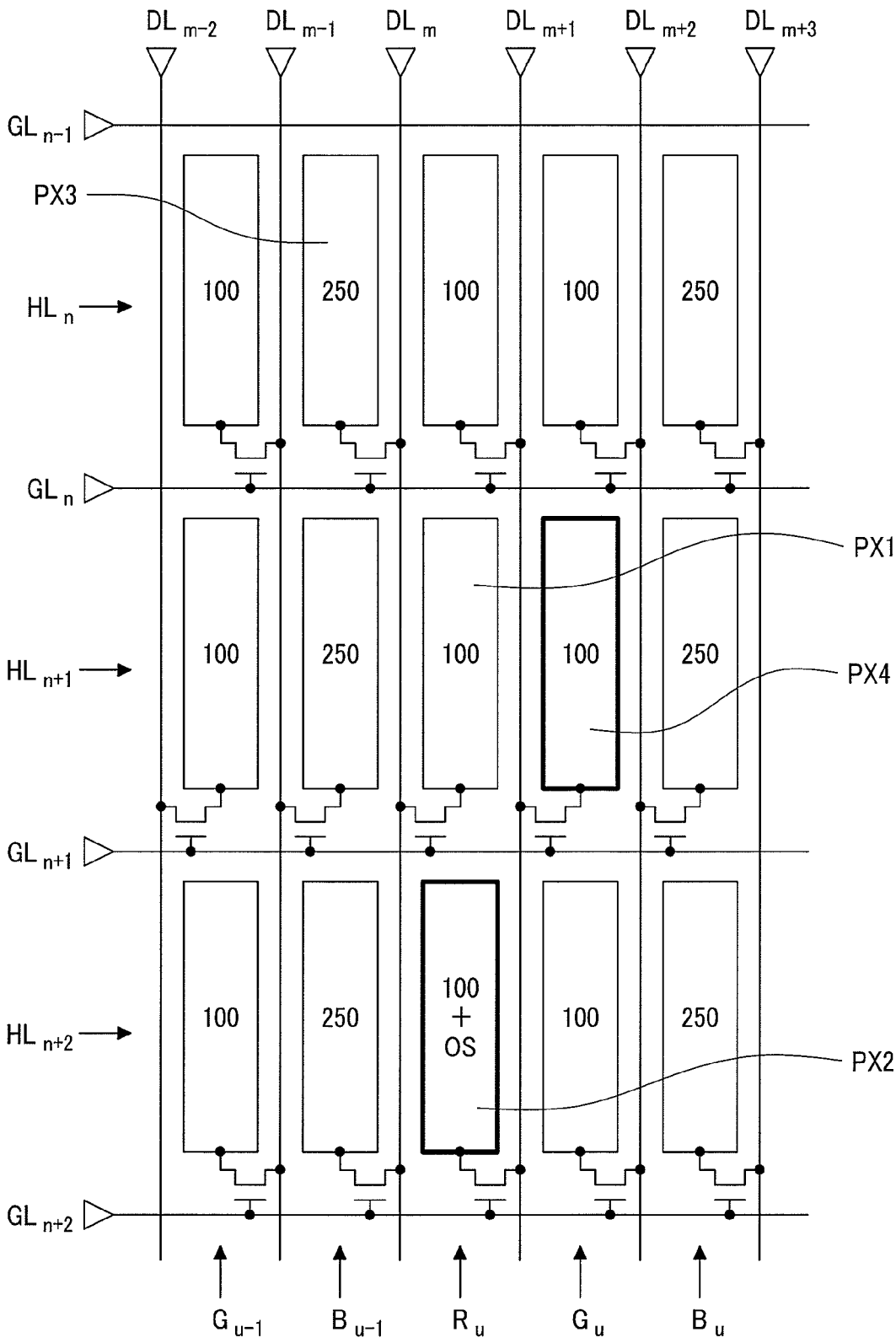
FIG. 6A is a schematic circuit diagram outlining a method for driving a liquid crystal display device according to a second embodiment.
Figure 6B:
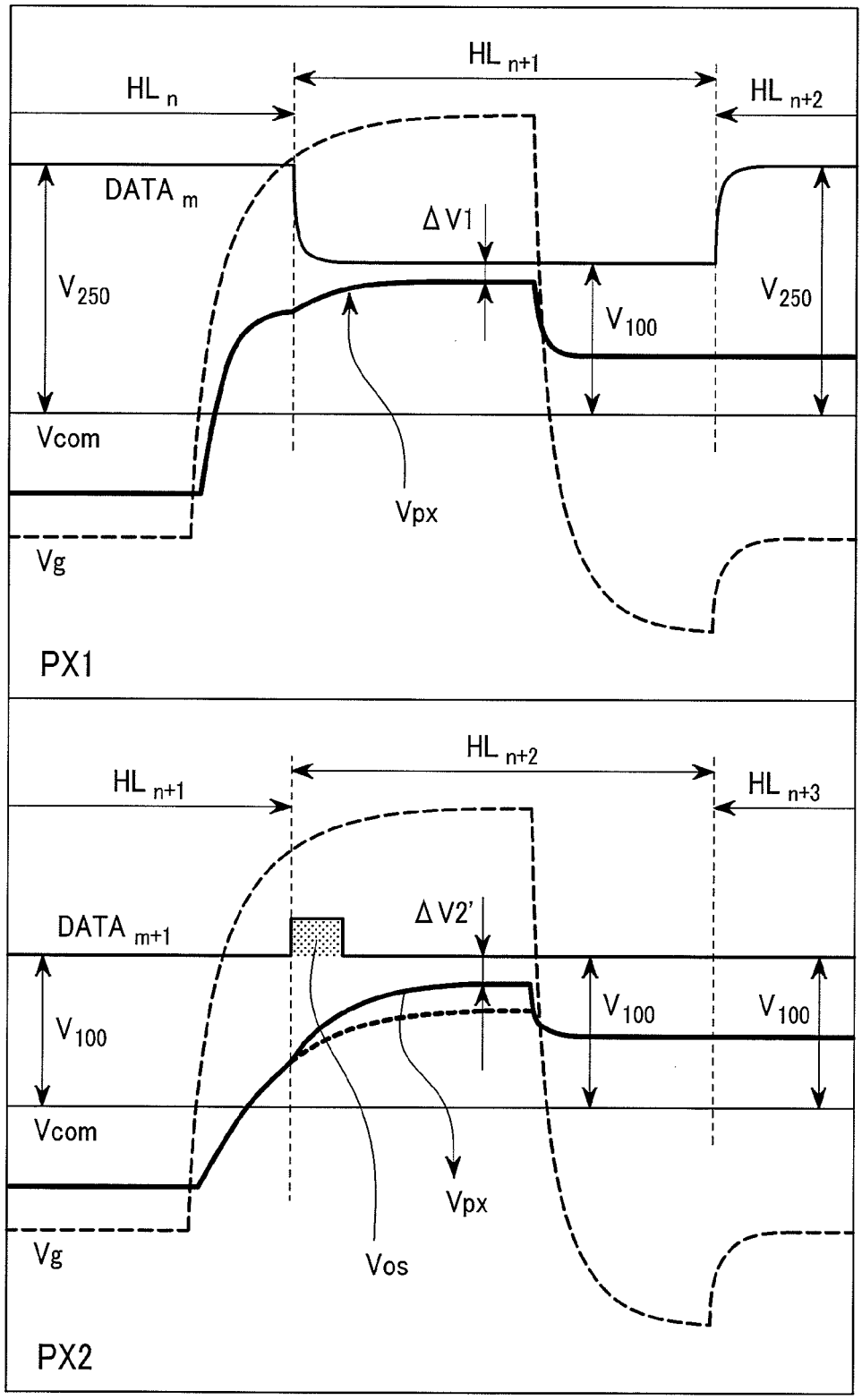
FIG. 6B is a set of schematic waveform diagrams illustrating typical tone voltages to be written into two pixel electrodes PX1, PX2 shown in FIG. 6A.

FIGS. 6A and 6B are schematic diagrams illustrating a typical method for driving the TFT liquid crystal display device according to a second embodiment of the present invention.

FIG. 6A is a schematic circuit diagram outlining the method for driving the liquid crystal display device according to the second embodiment. FIG. 6B is a set of schematic waveform diagrams illustrating typical tone voltages to be written into two pixel electrodes PX1, PX2 shown in FIG. 6A.

The second embodiment causes the video signal to be written, for instance, into pixel electrode PX2 to overshoot or undershoot in accordance with the tone difference between the video signal for pixel electrode PX2 and the video signal, for instance, for pixel electrode PX4 in line $HL_{n+1}$, column $G_u$, namely, the preceding pixel electrode connected to the video signal line $DL_{m+1}$ to which pixel electrode PX2 is connected through a TFT for the purpose reducing the difference between, for instance, the insufficiency of a tone voltage written into pixel electrode PX1, which is shown in FIG. 2A, and the insufficiency of a tone voltage written into pixel electrode PX2.

When, for instance, the tones shown in FIG. 6A are used to display the pixels of the liquid crystal display panel 1, the relationship between the waveform of the tone voltage Vpx to be written into pixel electrode PX1, which is in line $HL_{n+1}$, column $R_u$, the waveform of the scanning signal Vg, the waveform of the common voltage Vcom, the waveform of the tone voltage Vpx to be written into pixel electrode PX1, and the waveform of video signal $DATA_m$ applied to the video signal line $DL_m$ is as shown in the upper half of FIG. 6B. This waveform relationship is the same as indicated in the upper half of FIG. 2B. There is a small potential difference ΔV1 between the voltage actually written into pixel electrode PX1 and the tone voltage for pixel electrode PX1 that is related to the video signal $DATA_m$ when the scanning signal Vg begins to fall.

On the other hand, when a conventional drive method is used, the relationship between the waveform of the tone voltage Vpx to be written into pixel electrode PX2, which is in line $HL_{n+2}$, column $G_u$, the waveform of the scanning signal Vg, the waveform of the common voltage Vcom, the waveform of the tone voltage Vpx to be written into pixel electrode PX2, and the waveform of video signal $DATA_{m+1}$ applied to the video signal line $DL_{m+1}$ is as shown in the lower half of FIG. 2B. As a result, the potential difference ΔV2 between the voltage actually written into pixel electrode PX2 and the tone voltage for pixel electrode PX2 that is related to the video signal $DATA_{m+1}$ when the scanning signal Vg begins to fall is greater than the potential difference ΔV1 between the voltage actually written into pixel electrode PX1 and the tone voltage for pixel electrode PX1 that is related to the video signal $DATA_m$.

As such being the case, the drive method according to the second embodiment causes the voltage Vpx to be written into pixel electrode PX2 to overshoot by applying a voltage Vos, which is higher than the voltage $V_{100}$ of the video signal to be written by ΔV, to period $HL_{n+2}$ of the video signal $DATA_{m+1}$, that is, for time Δt to the beginning of the video signal to be written into pixel electrode PX2, as indicated, for instance, in the lower half of FIG. 6B. In this instance, the potential difference ΔV2' between the voltage actually written into pixel electrode PX2 and the tone voltage for pixel electrode PX2 that is related to the video signal $DATA_{m+1}$ when the scanning signal Vg begins to fall is smaller than the potential difference ΔV2 shown in FIG. 2B.

Therefore, when the method for driving the TFT liquid crystal display device according to the second embodiment is used, the difference (ΔV2'−ΔV1) between the potential difference ΔV1 between the tone voltage $V_{100}$ of the video signal $DATA_m$ prevailing when the scanning signal Vg begins to fall and the voltage actually written in pixel electrode PX1 and the potential difference ΔV2' between the tone voltage $V_{100}$ of the video signal $DATA_{m+1}$ prevailing when the scanning signal Vg begins to fall and the voltage actually written into pixel electrode PX2 is smaller than ΔV2−ΔV1. This reduces the difference between the tone (brightness) of a pixel having pixel electrode PX1 and the tone (brightness) of a pixel having pixel electrode PX2, thereby making it possible to avoid image quality deterioration due to the occurrence of a phenomenon called "lateral stripes."

In the second embodiment, it goes without saying that the time Δt and potential difference ΔV for applying the voltage Vos for causing the voltage Vpx to be written into the pixel electrode PX (PX2) to overshoot can be set as desired and changed as needed.

The drive method according to the second embodiment can be implemented by furnishing the control circuit 4 with a correction circuit that is configured the same as the correction circuit 401 described in conjunction with the first embodiment. When the drive method according to the second embodiment is employed, the tone correction section 401*b* of the correction circuit 401 determines, for instance, the potential of the voltage Vos and the time of voltage application and adds the determined information to the tone data (video signal) instead of correcting the tone data itself.

Further, even when the method for driving the TFT liquid crystal display device according to the second embodiment is employed, it goes without saying that only the video signals for pixels in a line whose video signal delay time is longer than the threshold value may be corrected as shown, for instance, in FIG. 5B. It also goes without saying that an alternative would be to set some threshold values, define various ranges according to the threshold values, prepare correction tables for the defined ranges that provide different combinations, for instance, of the potential of the voltage Vos to be applied to a video signal and the voltage application time, and correct the video signals for various pixels in accordance with the correction tables, as shown, for instance, in FIG. 5C.

Third Embodiment

FIGS. 7A to 7D are schematic diagrams illustrating a typical method for driving the TFT liquid crystal display device according to a third embodiment of the present invention.

Figure 7A:
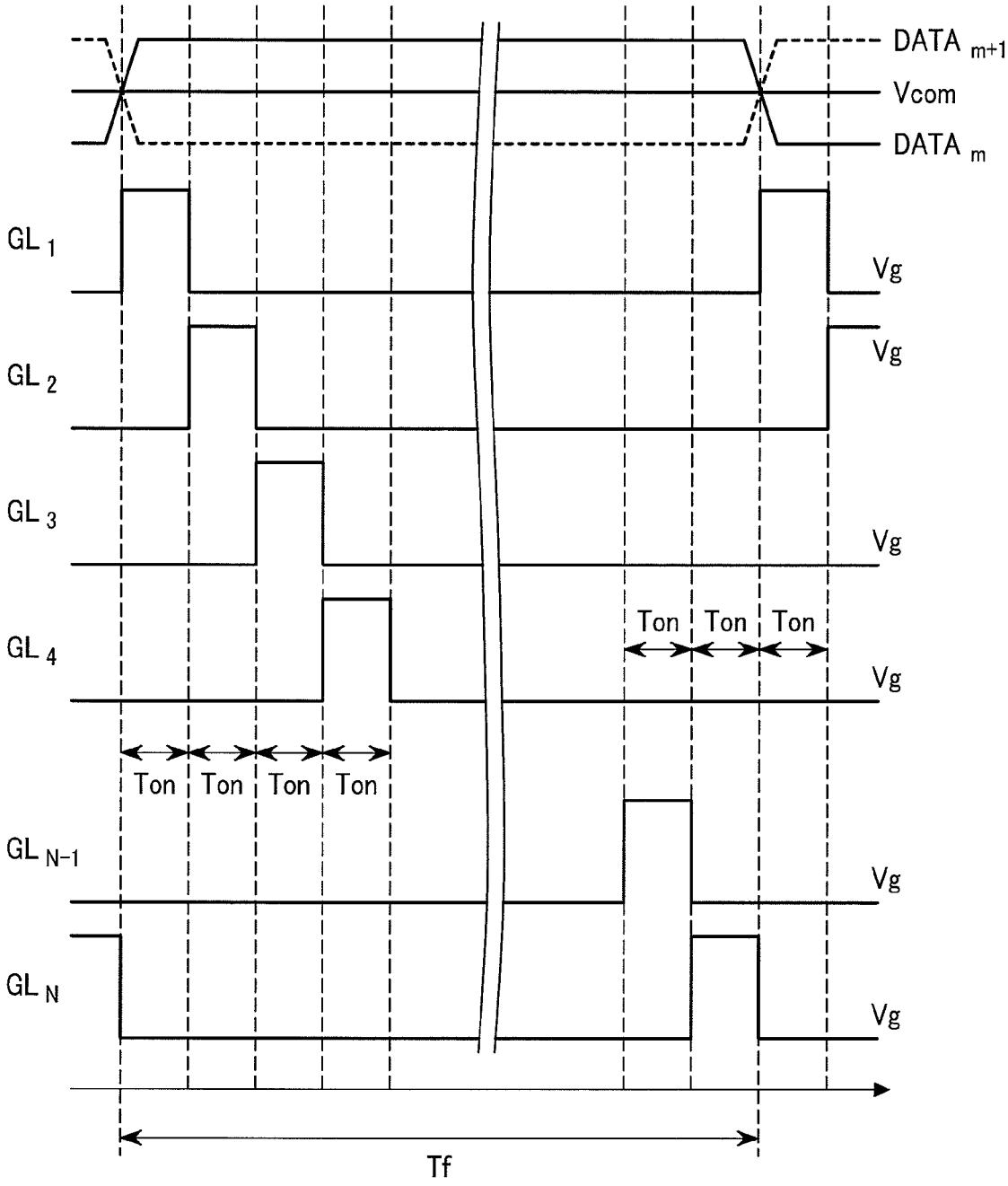
FIG. 7A is a schematic diagram illustrating a typical method for driving a conventional liquid crystal display device.
Figure 7B:
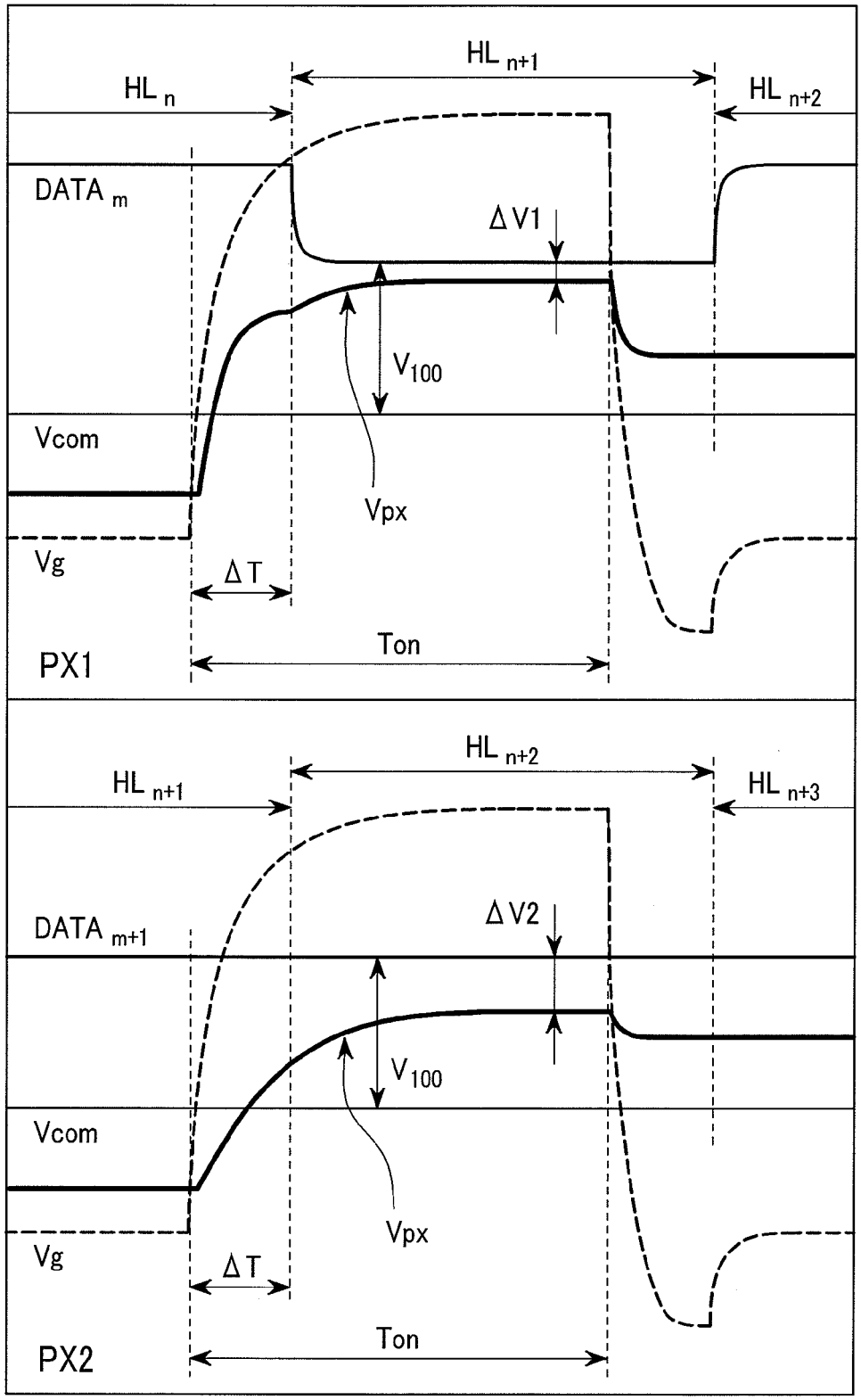
FIG. 7B is a set of schematic waveform diagrams illustrating the cause of lateral stripe generation from a viewpoint different from those of the first and second embodiments.
Figure 7C:
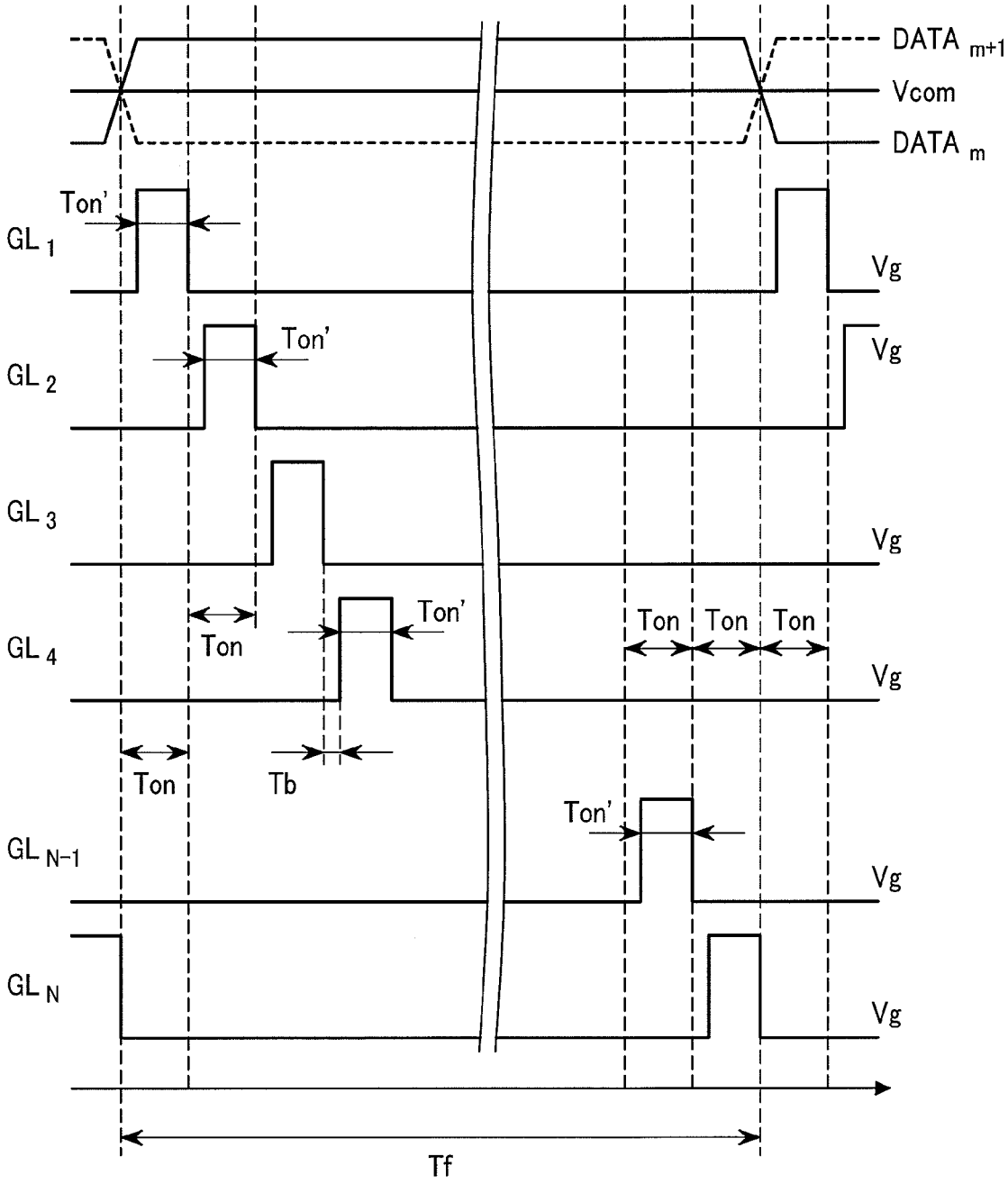
FIG. 7C is a schematic diagram illustrating a typical method for driving a liquid crystal display device according to a third embodiment.
Figure 7D:
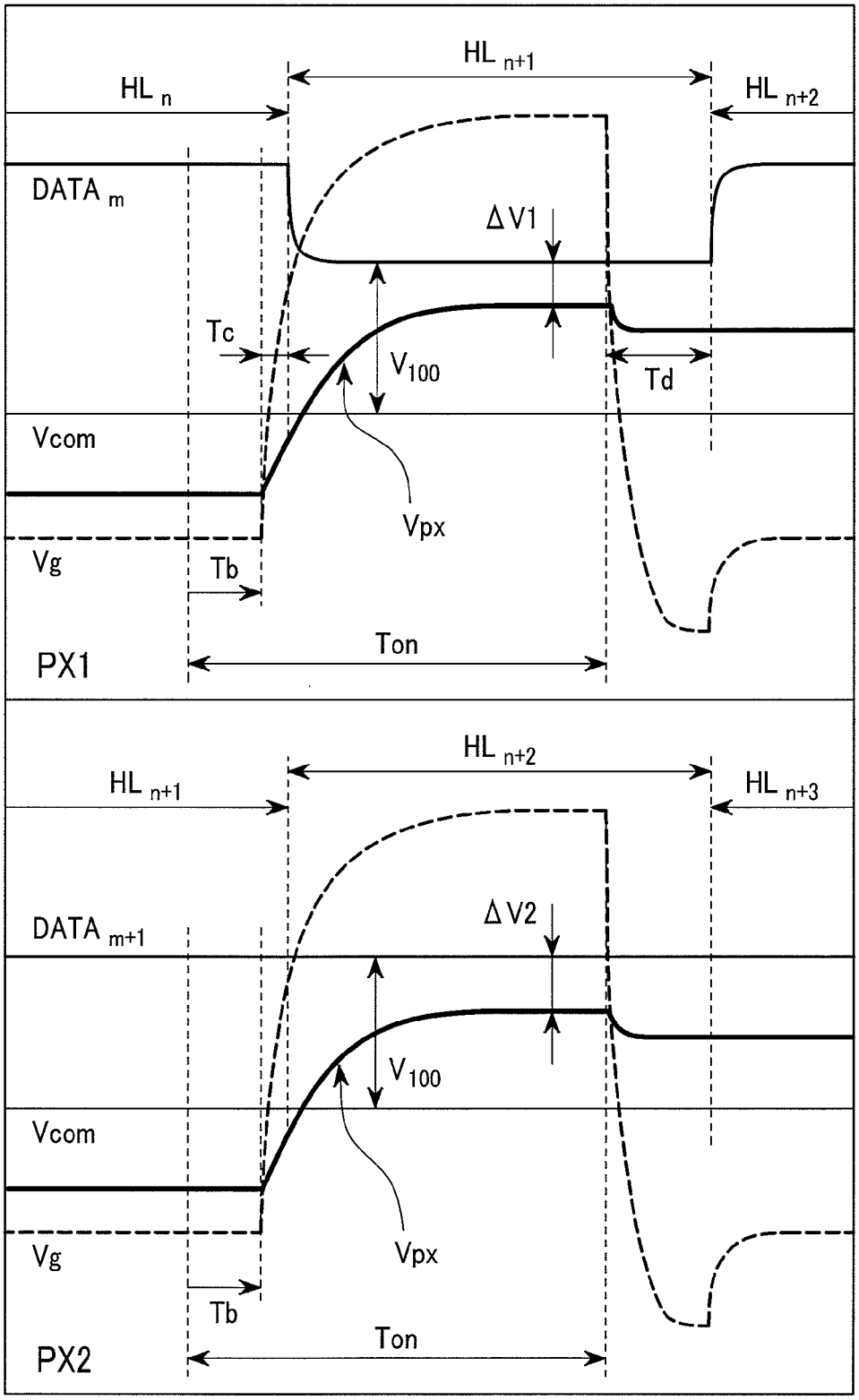
FIG. 7D is a set of schematic waveform diagrams illustrating the operational advantages of a method for driving the liquid crystal display device according to the third embodiment.

FIG. 7A is a schematic diagram illustrating a typical method for driving a conventional liquid crystal display device. FIG. 7B is a set of schematic waveform diagrams illustrating the cause of lateral stripe generation from a viewpoint different from those of the first and second embodiments. FIG. 7C is a schematic diagram illustrating a typical method for driving the liquid crystal display device according to the third embodiment. FIG. 7D is a set of schematic waveform diagrams illustrating the operational advantages of a method for driving the liquid crystal display device according to the third embodiment.

FIGS. 7B and 7D show examples of tone voltages to be written into the two pixels PX1, PX2 shown in FIG. 2A.

In conventional common liquid crystal display devices including the liquid crystal display devices described in conjunction with the first and second embodiments, the waveform of the scanning signal Vg applied to each scanning signal line GL looks, for instance, like FIG. 7A. FIG. 7A assumes that a liquid crystal display panel has N scanning signal lines, and shows the waveforms of scanning signals applied to four scanning signal lines $GL_1$, $GL_2$, $GL_3$, $GL_4$ positioned closest to the signal input end of a video signal line and two scanning signal lines $GL_{N-1}$, $GL_N$ positioned farthest from the signal input end of a video signal line. In addition to the waveforms of the scanning signals applied to the above-mentioned scanning signal lines, FIG. 7A also shows the video signal $DATA_m$ applied to video signal line $DL_m$, the video signal $DATA_{m+1}$ applied to video signal line $DL_{m+1}$, and a common electrode potential (common potential) Vcom.

In a conventional common liquid crystal display device, the scanning signal Vg applied to a scanning signal line GL is such that a TFT connected to the scanning signal line GL turns ON at predetermined time intervals Tf. In this instance, the scanning signal Vg applied to each scanning signal line GL turns ON the TFT for a period of time Ton that is generally determined by dividing the predetermined time intervals Tf by the total number N of scanning signal lines GL (Tf/N). The predetermined time intervals denote a frame cycle. The total number N of scanning signal lines GL is a total number that is obtained by adding the number of scanning lines within the display area to the number of scanning lines existing outside the display area.

In an actual liquid crystal device, the waveform of the scanning signal Vg applied to each scanning signal line GL is accentuated as shown in FIG. 7B. The scanning signal Vg having such a waveform is generally defined so that the status of the TFT changes from OFF to ON when the scanning signal Vg rises and changes from ON to OFF when the scanning signal Vg falls.

In other words, the time Ton during which the scanning signal Vg turns ON the TFT is defined as the time interval between the instant at which the scanning signal Vg rises and the instant at which the scanning signal Vg falls.

In an actual liquid crystal display device, there is a time difference ΔT between the time at which the scanning signal Vg changes the status of the TFT from OFF to ON and the time at which the signal applied to the video signal line DL changes to the signal to be written into the pixel electrode PX through the TFT, as indicated, for instance, in FIG. 7B. For a ΔT second period immediately after an OFF-to-ON status change in a TFT, therefore, the signal to be written into the preceding pixel electrode is written into the pixel electrode connected through the TFT. Consequently, the differences ΔV1, ΔV2 between the tone voltage $V_{100}$ to be written into pixel electrodes PX1 and PX2 and the tone voltage Vpx actually written into pixel electrodes PX1 and PX2 differ from each other. As a result, the lateral stripes arise.

From the viewpoint described above, the inventors of the present invention have found that the period of time during which the signal to be written into the preceding pixel electrode is written into the pixel electrode connected through a TFT immediately after an OFF-to-ON status change in the TFT should be reduced as a drive method that differs from those described in conjunction with the first and second embodiments. More specifically, the method for driving the liquid crystal display device according to the third embodiment decreases the time difference ΔT between the time at which the scanning signal Vg changes the status of a TFT from OFF to ON and the time at which the signal applied to the video signal line DL changes to the signal to be written into the pixel electrode PX through the TFT.

When the method for driving the liquid crystal display device according to the third embodiment is used, the waveform of the scanning signal Vg applied to each scanning signal line GL looks, for instance, like FIG. 7C. FIG. 7C assumes that a liquid crystal display panel has N scanning signal lines, and shows the waveforms of scanning signals applied to four scanning signal lines $GL_1$, $GL_2$, $GL_3$, $GL_4$ positioned closest to the signal input end of a video signal line and two scanning signal lines $GL_{N-1}$, $GL_N$ positioned farthest from the signal input end of a video signal line. In addition to the waveforms of the scanning signals applied to the above-mentioned scanning signal lines, FIG. 7C also shows the video signal $DATA_m$ applied to video signal line $DL_m$, the video signal $DATA_{m+1}$ applied to video signal line $DL_{m+1}$, and a common electrode potential (common potential) Vcom.

When the method for driving the liquid crystal display device according to the third embodiment is used, the period of time Ton' during which the scanning signal Vg applied to a scanning signal line GL turns ON the TFT connected to the scanning signal line GL is shorter than the value obtained by dividing the above-mentioned time intervals Tf by the total number N of scanning signal lines GL (Tf/N).

Further, the period of time Ton' during which the TFT is ON is made shorter than the conventional period of time Ton by delaying the time of allowing each scanning signal Vg to change the TFT status from OFF to ON (rise time) by time Tb, as indicated, for instance, in FIG. 7D.

Applying the above delay reduces the time difference ΔT between the time at which the scanning signal Vg changes the status of a TFT from OFF to ON and the time at which the video signal applied to a video signal line changes to the signal to be written into a pixel electrode through the TFT. This makes it possible to prevent the signal to be written into the preceding pixel electrode from being written into the pixel electrode connected to the TFT immediately after TFT turn-ON. Consequently, the differences ΔV1, ΔV2 between the tone voltage $V_{100}$ to be written into pixel electrodes PX1 and PX2 and the tone voltage Vpx actually written into pixel electrodes PX1 and PX2 become smaller, as indicated, for instance, in FIG. 7D, thereby reducing the possibility of image quality deterioration due to the occurrence of lateral stripes.

Moreover, the method for driving the liquid crystal display device according to the third embodiment uniformly changes the period of time during which the scanning signal applied to all scanning signal lines GL turns ON the TFT from Ton to Ton'. Therefore, the gate driver 3 for exercising control over scanning signal generation and application timing and a printed circuit board called a timing controller can be preadjusted so that the period of time during which the TFT is turned ON is Ton'. In other words, the liquid crystal display device implementing the drive method described in conjunction with the third embodiment can avoid the occurrence of lateral stripes and reduce the possibility of image quality deterioration without adding the correction circuit 401 as described in conjunction with the first and second embodiments.

The drive method according to the third embodiment can be defined as described below when it is viewed from a different angle. If, as shown in FIG. 7D, the difference between the time at which the scanning signal Vg rises and the time at which the video signal changes to the signal to be written into a pixel electrode to which the TFT is connected is Tc and the difference between the time at which the scanning signal Vg falls and the time at which the video signal changes to the signal to be written into the pixel electrode subsequent to the pixel electrode to which the TFT is connected is Td, Td>Tc.

While the present invention has been described in terms of the preferred embodiments, which have been described above, the reader should understand that the invention is not limited to those preferred embodiments, but extends to various modifications that nevertheless fall within the scope of the appended claims.

For example, the first to third embodiments assume that the signal input end of the video signal for a video signal line DL is positioned at one end of the video signal line DL and toward the upper end of the display area (toward scanning signal line $GL_1$). However, the signal input end of some recent TFT liquid crystal display devices is positioned toward the lower end of the display area DA (toward scanning signal line $GL_N$). Some other recent TFT liquid crystal display devices have signal input ends at both ends (upper and lower ends) of the display area DA. Even when the liquid crystal display panels of such TFT liquid crystal devices are driven in a manner described in conjunction with the first, second, or third embodiment of the present invention, it is possible to prevent image quality deterioration by avoiding the occurrence of a phenomenon called "lateral stripes."

What is claimed is:

1. A display device comprising:

a plurality of scanning signal lines;

a plurality of video signal lines;

a plurality of TFTs;

a plurality of pixel electrodes connected to sources of the TFTs;

a display panel in which the plurality of pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plurality of pixel electrodes against the tone of video data to be written into a preceding pixel electrode that is connected through a TFT to the video signal line, to which the one of the plurality of pixel electrodes is also connected through a TFT, and placed one position toward a signal input end of the video signal line as compared to the one of the plurality of pixel electrodes, and corrects the video data to be written into the one of the plurality of pixel electrodes;

wherein the correction circuit includes tone correction means which makes a correction by changing the tone of video data to be written into the one of the plurality of pixel electrodes; and wherein, when the distance between the one of the plurality of pixel electrodes and the signal input end of the video signal line is greater than a predetermined value, the tone correction means corrects the tone of the video data.

2. A display device comprising:

a plurality of scanning signal lines;

a plurality of video signal lines;

a plurality of TFTs;

a plurality of pixel electrodes connected to sources of the TFTs;

a display panel in which the plurality of pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plurality of pixel electrodes against the tone of video data to be written into a preceding pixel electrode that is connected through a TFT to the video signal line, to which the one of the plurality of pixel electrodes is also connected through a TFT, and placed one position toward a signal input end of the video signal line as compared to the one of the plurality of pixel electrodes, and corrects the video data to be written into the one of the plurality of pixel electrodes;

wherein the correction circuit includes tone correction means which makes a correction by changing the tone of video data to be written into the one of the plurality of pixel electrodes; and wherein the tone correction means varies the amount of tone correction for the video data in accordance with the distance between the one of the plurality of pixel electrodes and the signal input end of the video signal line.

3. A display device comprising:

a plurality of scanning signal lines;

a plurality of video signal lines;

a plurality of TFTs;

a plurality of pixel electrodes connected to sources of the TFTs;

a display panel in which the plurality of pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plurality of pixel electrodes against the tone of video data to be written into a preceding pixel electrode that is connected through a TFT to the video signal line, to which the one of the plurality of pixel electrodes is also connected through a TFT, and placed one position toward a signal input end of the video signal line as compared to the one of the plurality of pixel electrodes, and corrects the video data to be written into the one of the plurality of pixel electrodes;

wherein the correction circuit includes tone correction means which makes a correction by applying to the beginning of video data to be written into the one of the plurality of pixel electrodes a signal having a voltage different from a voltage corresponding to the tone of the video data in accordance with the difference between the tone of video data to be written into the one of the plurality of pixel electrodes and the tone of video data to be written into the preceding pixel electrode; and wherein, when the distance between the one of the plurality of pixel electrodes and the signal input end of the video signal line is greater than a predetermined value, the tone correction means makes a correction by applying a signal having a voltage different from a voltage corresponding to the tone of video data to be written into the one of the plurality of pixel electrodes.

4. A display device comprising:

a plurality of scanning signal lines;

a plurality of video signal lines;

a plurality of TFTs;

a plurality of pixel electrodes connected to sources of the TFTs;

a display panel in which the plurality of pixel electrodes are positioned between two neighboring video signal lines and arranged in the extending direction of the video signal lines, a pixel electrode connected to one of the two neighboring video signal lines through a TFT and a pixel electrode connected to the other video signal line through a TFT being alternately arranged; and a correction circuit that compares the tone of video data to be written into one of the plurality of pixel electrodes against the tone of video data to be written into a preceding pixel electrode that is connected through a TFT to the video signal line, to which the one of the plurality of pixel electrodes is also connected through a TFT, and placed one position toward a signal input end of the video signal line as compared to the one of the plurality of pixel electrodes, and corrects the video data to be written into the one of the plurality of pixel electrodes;

wherein the correction circuit includes tone correction means which makes a correction by applying to the beginning of video data to be written into the one of the plurality of pixel electrodes a signal having a voltage different from a voltage corresponding to the tone of the video data in accordance with the difference between the tone of video data to be written into the one of the plurality of pixel electrodes and the tone of video data to be written into the preceding pixel electrode; and wherein the tone correction means varies one or both of a magnitude and application time of a voltage different from a voltage corresponding to the tone of video data to be written into the one of the plurality of pixel electrodes in accordance with the distance between the one of the plurality of pixel electrodes and the signal input end of the video signal line.

5. The display device according to claim 1, wherein the correction circuit includes a line memory that is positioned between two neighboring scanning signal lines, which are included in one frame period of video data, to store video data to be written into each of a plurality of pixel electrodes arranged in the extending direction of the scanning signal lines.

6. The display device according to claim 2, wherein the correction circuit includes a line memory that is positioned between two neighboring scanning signal lines, which are included in one frame period of video data, to store video data to be written into each of a plurality of pixel electrodes arranged in the extending direction of the scanning signal lines.

7. The display device according to claim 3, wherein the correction circuit includes a line memory that is positioned between two neighboring scanning signal lines, which are included in one frame period of video data, to store video data to be written into each of a plurality of pixel electrodes arranged in the extending direction of the scanning signal lines.

8. The display device according to claim 4, wherein the correction circuit includes a line memory that is positioned between two neighboring scanning signal lines, which are included in one frame period of video data, to store video data to be written into each of a plurality of pixel electrodes arranged in the extending direction of the scanning signal lines.

9. The display device according to claim 1, wherein the tone correction means varies the amount of tone correction for the video data to be written into the one of the plurality of pixel electrodes in accordance with the difference between the tone of the video data to be written into the one of the plurality of pixel electrodes and the tone of video data to be written into the preceding pixel electrode.

10. The display device according to claim 2, wherein the tone correction means varies the amount of tone correction for the video data to be written into the one of the plurality of pixel electrodes in accordance with the difference between the tone of the video data to be written into the one of the plurality of pixel electrodes and the tone of video data to be written into the preceding pixel electrode.

11. The display device according to claim 1, wherein the display panel is a liquid crystal display panel that is obtained by interposing liquid crystal between two substrates.

12. The display device according to claim 2, wherein the display panel is a liquid crystal display panel that is obtained by interposing liquid crystal between two substrates.

13. The display device according to claim 3, wherein the display panel is a liquid crystal display panel that is obtained by interposing liquid crystal between two substrates.

14. The display device according to claim 4, wherein the display panel is a liquid crystal display panel that is obtained by interposing liquid crystal between two substrates.

* * * * *